US007227428B2

(12) United States Patent
Fukunaga

(10) Patent No.: US 7,227,428 B2
(45) Date of Patent: Jun. 5, 2007

(54) RF MODULE AND MODE CONVERTING STRUCTURE HAVING MAGNETIC FIELD MATCHING AND PENETRATING CONDUCTOR PATTERNS

(75) Inventor: Tatsuya Fukunaga, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 10/693,728

(22) Filed: Oct. 27, 2003

(65) Prior Publication Data

US 2004/0085151 A1 May 6, 2004

(30) Foreign Application Priority Data

Oct. 29, 2002 (JP) ..... 2002-313854

(51) Int. Cl.
*H01P 5/107* (2006.01)

(52) U.S. Cl. ..... 333/26; 333/21 R

(58) Field of Classification Search ..... 333/21 R, 333/26, 248

See application file for complete search history.

(56) References Cited

U.S. PATENT DOCUMENTS

| | | | | |
|---|---|---|---|---|
| 3,265,995 | A * | 8/1966 | Hamasaki | 333/21 R |
| 4,017,864 | A * | 4/1977 | Proctor | 343/767 |
| 4,562,416 | A | 12/1985 | Sedivec | |
| 5,559,480 | A * | 9/1996 | Ivanivsky | 333/21 R |
| 5,982,256 | A * | 11/1999 | Uchimura et al. | 333/239 |
| 6,242,984 | B1 * | 6/2001 | Stones et al. | 330/295 |
| 6,380,825 | B1 * | 4/2002 | Takenoshita et al. | 333/137 |
| 6,396,364 | B1 | 5/2002 | Qvist | |

FOREIGN PATENT DOCUMENTS

| | | |
|---|---|---|
| EP | 0 883 328 A1 | 12/1998 |
| JP | A 6-53711 | 2/1994 |
| JP | A 11-284409 | 10/1999 |
| JP | A 2000-216605 | 8/2000 |
| JP | A-2002-026611 | 1/2002 |
| JP | A 2002-135003 | 5/2002 |
| JP | A 2003-110307 | 4/2003 |

OTHER PUBLICATIONS

Awai et al., A Dual Mode Dielectric Waveguide Resonator and Its Application to Bandpass Filters, IEICE Transactions on Electronics, E78-C (1995), August, No. 8, Tokyo, JP.

Deslandes et al., Integrated Microstrip and Retangular Waveguide in Planar Form, IEEE Microwave and Wireless Components Letters, vol. 11, No. 2, Feb. 2001.

* cited by examiner

*Primary Examiner*—Benny Lee
(74) *Attorney, Agent, or Firm*—Oliff & Berridge, PLC

(57) ABSTRACT

The present invention is directed to enable mode conversion between a TEM mode and another mode to be performed among a plurality of waveguides. An RF module comprises: a microstrip line as a first waveguide for propagating electromagnetic waves in a TEM mode; and a waveguide having a multilayer structure as a second waveguide connected to the first waveguide, for propagating electromagnetic waves in another mode different from the TEM mode. An end of the first waveguide is directly or indirectly connected so as to be conductive to one of ground electrodes of the second waveguide from the direction orthogonal to the stacking direction of the ground electrodes. Since magnetic fields are coupled so that the direction of the magnetic field of the first waveguide and that of the magnetic field of the second waveguide match with each other in the E plane, mode conversion between the TEM mode and another mode to be excellently performed between the waveguides.

9 Claims, 19 Drawing Sheets

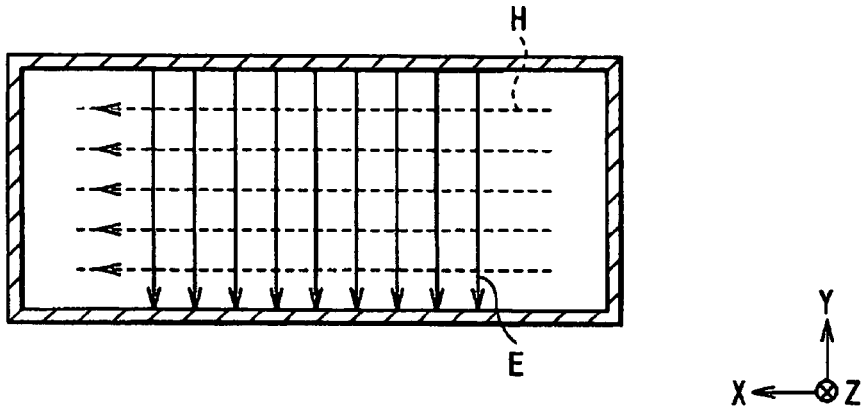
FIG. 20
RELATED ART
FIG. 21A
RELATED ART
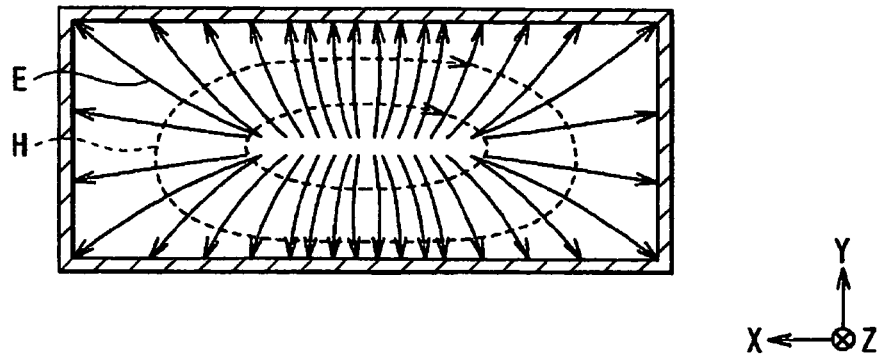
FIG. 21B
RELATED ART
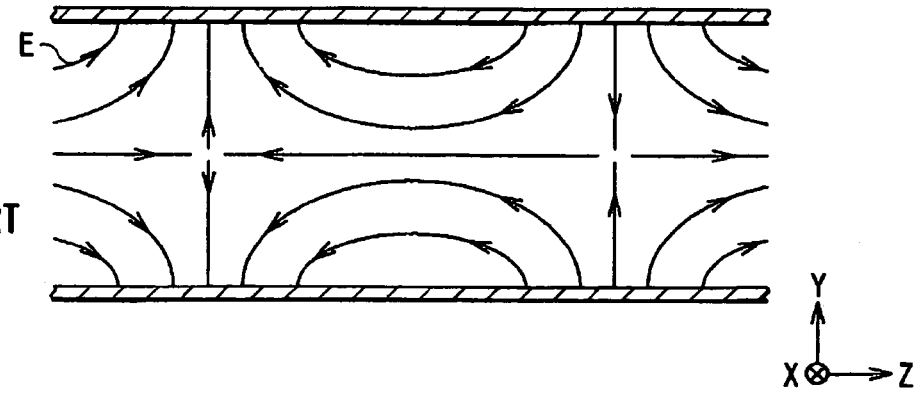

RF MODULE AND MODE CONVERTING STRUCTURE HAVING MAGNETIC FIELD MATCHING AND PENETRATING CONDUCTOR PATTERNS

BACKGROUND OF THE INVENTION

1. Field of the Invention

The present invention relates to an RF module used for propagating a signal in a high frequency band of microwaves, millimeter waves, or the like and a mode converting structure and method for converting a mode between different waveguides.

2. Description of the Related Art

Conventionally, as transmission lines for transmitting a high frequency signal in a microwave band, a millimeter wave band, and the like, a strip line, a microstrip line, a coaxial line, a waveguide, a dielectric waveguide, and the like are known. Each of them is also known as a component of a resonator and a filter for high frequency signal. An example of a module formed by using any of the components for high frequency is an MMIC (Monolithic Microwave IC). Hereinbelow, a transmission line for high frequency, and a microstrip line, a waveguide, or the like each serving as a component of a filter or the like will be generically called waveguides.

Propagation modes of electromagnetic waves in a waveguide will now be described. FIGS. 19A and 19B show an electric field distribution and a magnetic field distribution, respectively, in a state called a TE mode ($TE_{10}$ mode) in a rectangular waveguide. The positions of sections S1, S2, S3, S4 and S5 in FIG. 19A and those in FIG. 19B correspond to each other. FIG. 20 shows an electromagnetic distribution in the section S1. As shown in FIG. 19A. FIG. 19B and FIG. 20, a state in which electric field components exist only in the section direction, and electric field components do not exist in an electromagnetic wave travel direction (waveguide axial direction) Z is called the "TE mode".

FIGS. 21A and 21B show electromagnetic field distributions in a state called a TM mode ($TM_{11}$ mode). FIG. 21A shows an electromagnetic field distribution in an XY section orthogonal to the waveguide axial direction Z, and FIG. 21B shows an electromagnetic field distribution in a YZ section of a side face. As shown in FIG. 21A and FIG. 21B, a state in which magnetic field components exist only in the section direction and no magnetic field components exist in the electromagnetic wave travel direction Z is called the "TM mode".

In each of the modes, a plane parallel to an electric field E is called an "E plane" and an plane parallel to a magnetic field H is called an "H plane". In the examples of the TE mode of FIGS. 19A and 19B, a plane parallel to the XY plane is the E plane (FIG. 19A), and a plane parallel to the XZ plane is the H plane (FIG. 19B).

In a microstrip line, a coaxial line, or the like shown in FIGS. 22A and 22B, a state called a TEM mode exists. The microstrip line is obtained by, as shown in FIG. 22A, disposing a ground (earth) conductor 101 and a line pattern 103 made of a conductor having a line shape so as to face each other while sandwiching a dielectric 102. The coaxial line is obtained by, as shown in FIG. 22B, surrounding a central conductor 111 by a cylindrical ground conductor 112.

FIGS. 23A and 23B show electromagnetic field distributions in the TEM mode in the microstrip line and the coaxial line, respectively. A state in which, as shown in FIG. 23A and FIG. 23B, both of the electric field components and the magnetic field components exist only in sections and do not exist in the electromagnetic wave travel direction Z is called a "TEM mode".

In an RF module having a plurality of waveguides, a structure for mutually coupling the waveguides is necessary. In particular, in the case of coupling waveguides of different modes, a structure for performing mode conversion among the waveguides is required.

Conventionally, an example of known structures of connecting a microstrip line and a waveguide is that, as shown in FIG. 24, a ridge 121 is provided in the center of the waveguide. The line pattern 103 of the microstrip line is inserted in a portion where the ridge 121 is provided. In this case, on assumption that the microstrip line is in the TEM mode and the ridge waveguide is in the TE mode, the electric field distribution in the microstrip line is as show in FIG. 25A, and that in the ridge 121 is as shown in FIG. 25B. In a connection portion, by combining both of the electric field distributions, mode conversion is performed between the microstrip line and the ridge waveguide.

Recently, there is a known structure in which a dielectric waveguide line is formed by a stacking technique in a wiring board of a multilayer structure. The structure has a plurality of ground conductors stacked while sandwiching dielectrics and through holes of which inner faces are metalized to make the ground conductors conductive, and electromagnetic waves are propagated in a region surrounded by the ground conductors and the through holes. A structure in which the waveguide having the multilayer structure is connected to a microstrip line is disclosed in, for example, Japanese Unexamined Patent Publication No. 2000-216605. The structure disclosed in this publication is basically similar to the structure using a ridge waveguide. In a center portion of the waveguide, a ridge is falsely formed in a step shape by using the through hole.

Another example of the structure of connecting waveguides of different kinds is that an input/output terminal electrode is provided in an end portion of a base of a dielectric resonator, and the input/output terminal electrode is connected to a line pattern on a printed board (Japanese Unexamined Patent Publication No. 2002-135003).

Conventionally, some structures of connecting different waveguides are known as described above. On the other hand, the waveguide having the multilayer structure is a relatively new technique, and the structure of connecting different waveguides has not been developed sufficiently. In particular, in the case of connecting a waveguide in the TEM mode and a waveguide having the multilayer structure, the converting structure for properly converting the mode among the waveguides has room for improvement.

SUMMARY OF THE INVENTION

The present invention has been achieved in consideration of such problems and its object is to provide an RF module and a mode converting structure and method capable of excellently performing mode conversion between a TEM mode and another mode among a plurality of waveguides.

An RF module according to the invention comprises: a first waveguide for propagating electromagnetic waves in a TEM mode; and a second waveguide connected to the first waveguide, for propagating electromagnetic waves in another mode different from the TEM mode. The second waveguide has a region surrounded by at least two ground electrodes facing each other and conductors for bringing at least two ground electrodes into conduction, and electromagnetic waves propagate in the region. The first waveguide extends in a direction orthogonal to a stacking direction of the ground electrodes, and its end is directly or indirectly connected so as to be conductive to one of the ground electrodes of the second waveguide from the direction orthogonal to the stacking direction. Magnetic fields of the first and second waveguides are coupled in an E plane of the second waveguide so that the direction of the magnetic field of electromagnetic waves propagated in the first waveguide and that of the magnetic field of electromagnetic waves propagated in the second waveguide match with each other.

According to the invention, there is provided a mode converting structure for converting a mode between different waveguides of; a first waveguide for propagating electromagnetic waves in a TEM mode, and a second waveguide connected to the first waveguide, for propagating electromagnetic waves in another mode different from the TEM mode. The second waveguide has a region surrounded by at least two ground electrodes facing each other and conductors for bringing at least two ground electrodes into conduction, and electromagnetic waves propagate in the region. The first waveguide extends in a direction orthogonal to a stacking direction of the ground electrodes, an end of the first waveguide is directly or indirectly connected so as to be conductive to one of the ground electrodes of the second waveguide from the direction orthogonal to the stacking direction, and magnetic fields of the first and second waveguides are coupled in an E plane of the second waveguide so that the direction of the magnetic field of electromagnetic waves propagated through the first waveguide and that of the magnetic field of electromagnetic waves propagated through the second waveguide match with each other, thereby performing mode conversion.

According to the invention, there is also provided a method for converting a mode in a structure comprising: a first waveguide for propagating electromagnetic waves in a TEM mode; and a second waveguide connected to the first waveguide, for propagating electromagnetic waves in another mode different from the TEM mode. The second waveguide has a region surrounded by at least two ground electrodes facing each other and conductors for bringing at least two ground electrodes into conduction, and electromagnetic waves propagating in the region. The first waveguide extends in a direction orthogonal to a stacking direction of the ground electrodes, an end of the first waveguide is directly or indirectly connected so as to be conductive to one of the ground electrodes of the second waveguide from the direction orthogonal to the stacking direction side, and magnetic fields of the first and second waveguides are coupled in an E plane of the second waveguide so that the direction of the magnetic field of electromagnetic waves propagated through the first waveguide and that of the magnetic field of electromagnetic waves propagated through the second waveguide match with each other, thereby performing mode conversion.

In the RF module, the mode converting structure and method according to the invention, electromagnetic waves in the TEM mode propagate through the first waveguide. In the second waveguide, electromagnetic waves in a mode different from the TEM mode propagate in a region surrounded by at least two ground electrodes facing each other and conductors for bringing at least two ground electrodes into conduction. An end of the first waveguide is directly or indirectly connected so as to be conductive to one of the ground electrodes of the second waveguide from the direction orthogonal to the stacking direction side. Magnetic fields of the first and second waveguides are coupled in an E plane of the second waveguide so that the direction of the magnetic field of electromagnetic waves propagated through the first waveguide and that of the magnetic field of electromagnetic waves propagated through the second waveguide match with each other. Thus, mode conversion between the TEM mode and another mode is performed in the connection portion between the first and second waveguides.

In the RF module according to the invention, the first waveguide may be positioned between the ground electrodes facing each other in the second waveguide, and an end of the first waveguide may be conductively connected to one of the ground electrodes facing each other.

In this case, in the connection portion of the first waveguide, a window may be provided on at least one of the ground electrode side to which the first waveguide is conductively connected or a side opposite to the ground electrode side.

In the RF module according to the invention, the first waveguide may have a line pattern made of a conductor formed on a dielectric substrate. In this case, preferably, a plurality of penetrating conductors penetrating the dielectric substrate are provided around the line pattern and the interval in the width direction of the penetrating conductors is equal to or less than a cut-off frequency of the electromagnetic waves propagating through the first waveguide.

With the configuration, propagation of the electromagnetic waves in a mode other than the TEM mode is suppressed in the first waveguide.

In the case where a plurality of penetrating conductors are provided around a line pattern, by adjusting the interval between the penetrating conductors, coupling between the first and second waveguides can be adjusted.

In the RF module according to the invention, a penetrating conductor for coupling adjustment may be provided in a coupling portion between the first and second waveguides.

The RF module according to the invention may have a configuration such that the second waveguide has a stacking structure in which three or more ground electrodes are stacked and has a plurality of propagation regions for propagating electromagnetic waves in the stacking direction, and an end of the first waveguide is conductively connected to the ground electrode between neighboring propagation regions in the second waveguide.

An end of the first waveguide can be conductively connected to a ground electrode between neighboring propagation regions in the second waveguide so that electromagnetic waves propagated through the first waveguide are branched and propagated into the plurality of propagation regions in the second waveguide.

Other and further objects, features and advantages of the invention will appear more fully from the following description.

BRIEF DESCRIPTION OF THE DRAWINGS

FIG. 20 is a diagram showing an electromagnetic field distribution in an E plane in the waveguide in the TE mode.

FIGS. 21A and 21B are diagrams each illustrating an electromagnetic field distribution in the waveguide in the TM mode.

DETAILED DESCRIPTION OF THE PREFERRED EMBODIMENTS

Figure 1:
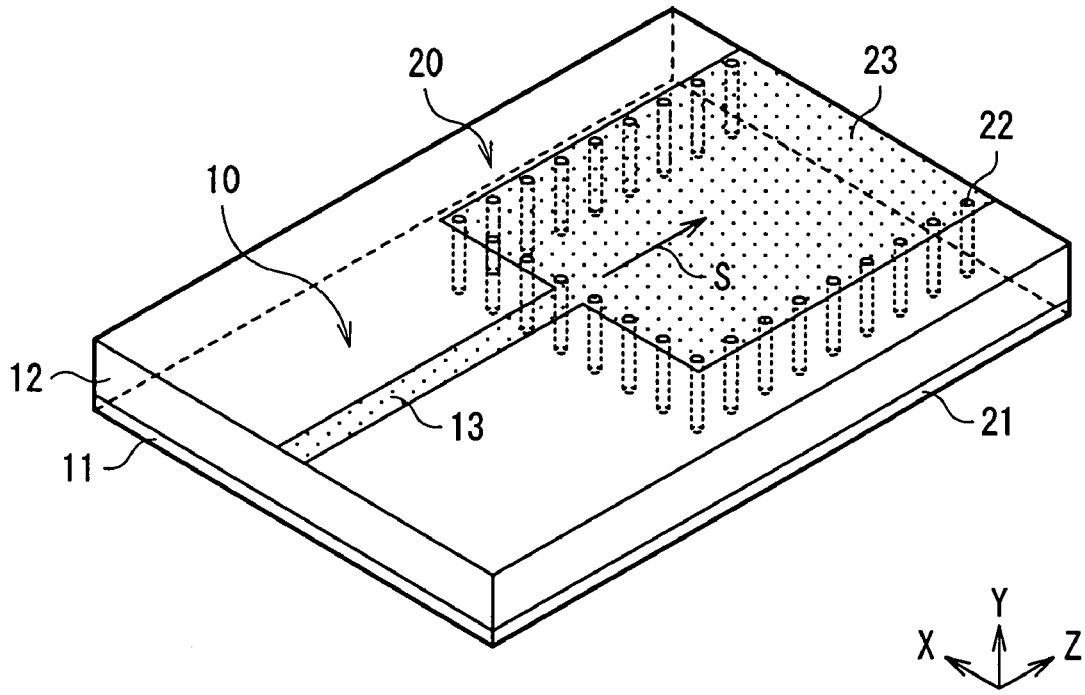
FIG. 1 is a perspective view showing an example of the configuration of an RF module according to an embodiment of the invention.

Embodiments of the invention will now be described in detail hereinbelow with reference to the drawings, where like features appearing in different drawing figures are denoted by like reference numerals and may not be described in detail for all drawing figures in which they appear.

Figure 2:
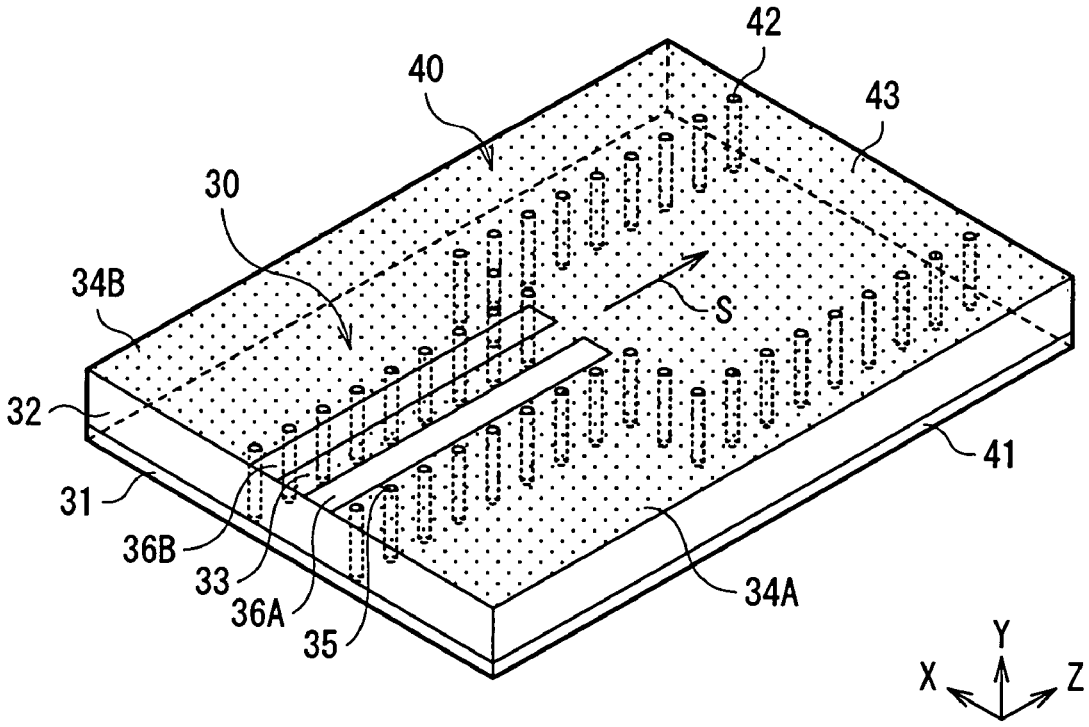
FIG. 2 is a perspective view showing another example of the configuration of the RF module according to the embodiment of the invention.
Figure 3:
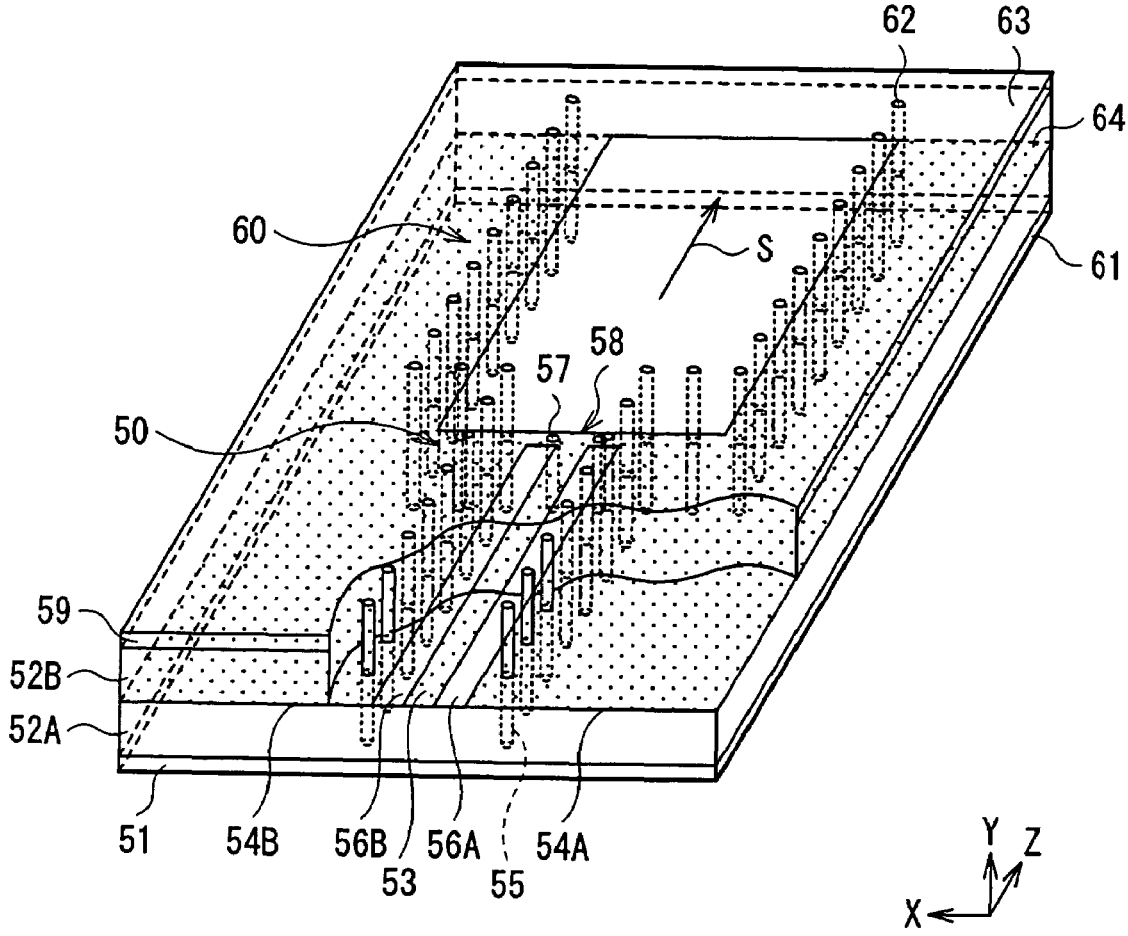
FIG. 3 is a partially cutaway perspective view showing further another example of the configuration of the RF module according to the embodiment of the invention.

FIGS. 1 to 3 show examples of the configuration of an RF module according to an embodiment of the invention. Each of the examples of the configuration of FIGS. 1 to 3 relates to an RF module having a first waveguide for propagating electromagnetic waves in a TEM mode and a second waveguide coupled to the first waveguide, for propagating electromagnetic waves in another mode which is different from the TEM mode. The RF module has a structure of performing conversion between the TEM mode and another mode. The RF module can be used for, for example, a transmission line for high frequency signal, a filter, or the like. In FIGS. 1 and 2, for simplicity of the drawing, the thickness of the uppermost layer is omitted and the uppermost layer is hatched. In FIG. 3, the thickness of an intermediate layer is omitted and the intermediate layer is hatched.

In the RF module shown in FIG. 1 as a configuration example, a microstrip line 10 is used as the first waveguide, and a waveguide 20 having a multilayer structure is used as the second waveguide. The microstrip line 10 and the waveguide 20 share a single dielectric substrate 12 and are constructed integrally.

As shown in FIG. 1, the waveguide 20 has ground electrodes 21 and 23 which face each other while sandwiching the dielectric substrate 12 and a plurality of through holes 22 as conductors for bringing the ground electrodes 21 and 23 into conduction. In the waveguide 20, electromagnetic waves propagate, for example, in an S direction in the diagram in a region surrounded by the ground electrodes 21 and 23 and the through holes 22. The waveguide 20 may have a configuration of a dielectric waveguide in which the electromagnetic wave propagation region is filled with a dielectric or a configuration of a cavity waveguide having therein a cavity. The through holes 22 are provided at intervals of a certain value or less (for example, ¼ of a signal wavelength or less) so that the propagating electromagnetic waves are not leaked. The inner face of the through hole 22 is metalized. The sectional shape of the through hole 22 is not limited to a circular shape but may be another shape such as a polygon shape or an oval shape.

The microstrip line 10 has a configuration that a ground electrode 11 made of a conductor and a line pattern 13 are disposed so as to face each other over the dielectric substrate 12. The ground electrode 11 is uniformly provided on the bottom face of the dielectric substrate 12. The line pattern 13 is provided in a line shape partially on the top face of the dielectric substrate 12.

The microstrip line 10 extends in a direction (Z direction) orthogonal to a stacking direction of the ground electrodes 21 and 23 of the waveguide 20, and its end portion is directly connected to the ground electrode 23 as one of the ground electrodes from the stacking direction side and is made conductive. The magnetic field of the microstrip line 10 is connected in an E plane (plane parallel to the electric field) of the waveguide 20. When the waveguide 20 is in the TE mode and the travel direction S of the electromagnetic waves is the Z direction in FIG. 1, the E plane of the waveguide 20 is parallel to an XY plane of the diagram.

Figure 4A:
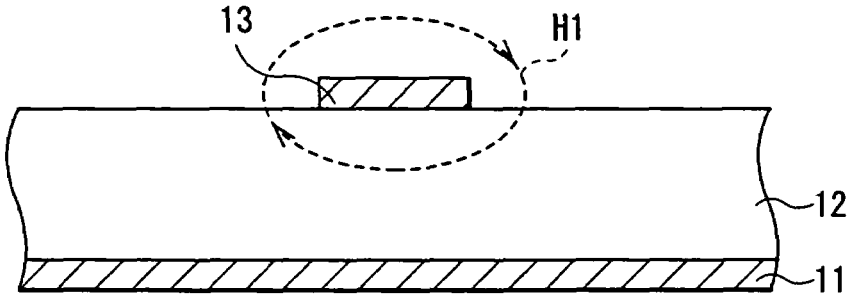
FIGS. 4A, 4B and 4C are diagrams each illustrating a magnetic field coupling portion in the RF module shown in FIG. 1.
Figure 4B:
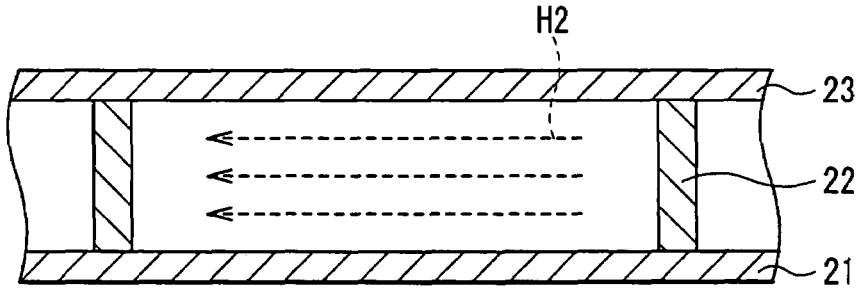
Figure 4C:
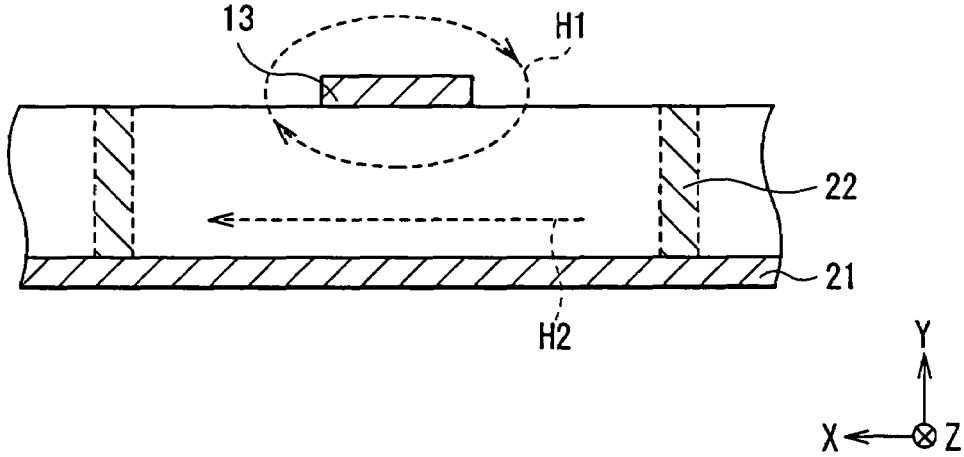

Each of FIGS. 4A, 4B and 4C shows a magnetic field distribution in the XY section of the connection portion between the microstrip line 10 and the waveguide 20 and its peripheral portion. Since the mode is the TEM mode, for example, as shown in FIG. 4A, a magnetic field H1 of the microstrip line 10 near the connection portion is distributed in a ring-shape around the line pattern 13. On the other hand, for example, in a TE mode of the lowest order ($TE_{10}$ mode), a magnetic field H2 of the waveguide 20 is distributed in one direction in the section as shown in FIG. 4B. Therefore, as shown in FIG. 4C, by matching the direction of the magnetic field H1 in the microstrip line 10 and that of the magnetic field H2 of the waveguide 20 in the E plane of the waveguide 20, the magnetic fields are coupled and conversion from the TEM mode to the TE mode is performed.

Figure 5:
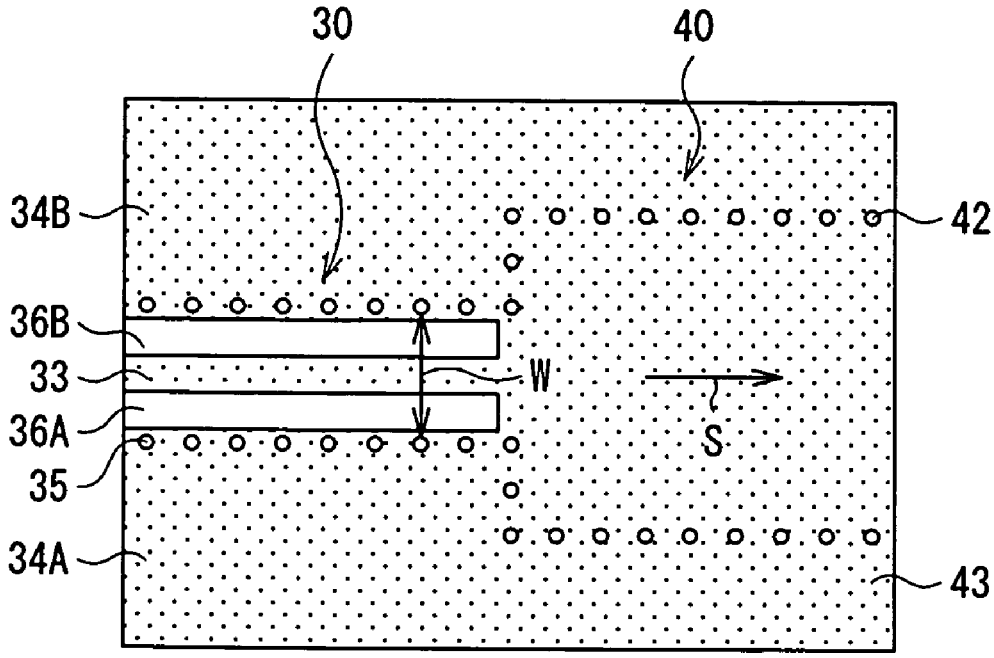
FIG. 5 is a plan view of the RF module shown in FIG. 2.

In the RF module shown in FIG. 2 as a configuration example, a coplanar line 30 is used as the first waveguide, and a waveguide 40 having a multilayer structure is used as the second waveguide. The coplanar line 30 and the waveguide 40 share a single dielectric substrate 32 and are constructed integrally. FIG. 5 is a plan view of the RF module.

The configuration of the waveguide 40 shown in FIG. 2 is basically similar to that of the waveguide 20 in FIG. 1. As shown in FIG. 2, the waveguide 40 has ground electrodes 41 and 43 which face each other and a plurality of through holes 42 as conductors for bringing the ground electrodes 41 and 43 into conduction. Electromagnetic waves propagate, for example, in an S direction in the diagram in a region surrounded by the ground electrodes 41 and 43 and the through holes 42.

The coplanar line 30 has a ground electrode 31 formed uniformly on the bottom face of the dielectric substrate 32, a line pattern 33 made of a conductor formed in a line shape on the top face of the dielectric substrate 32, and ground electrodes 34A and 34B formed in the width direction of the line pattern 33. In the width direction of the line pattern 33, between the ground electrodes 34A and 34B, regions 36A and 36B in which a conductor is not provided are formed.

In the coplanar line 30, a plurality of through holes 35 as penetrating conductors are provided along the line pattern 33. The inner face of the through hole 35 is metalized. The through hole 35 penetrates the dielectric substrate 32 and brings the ground electrodes 34A and 34B on the top face and a ground electrode 31 on the bottom face into conduction. The sectional shape of the through hole 35 is not limited to a circular shape but may be another shape such as a polygonal shape or an oval shape. The through holes 35 are provided at an interval W (refer to FIG. 5) in the width direction while sandwiching the line pattern 33 to prevent electromagnetic waves in modes (TE and TM modes) other than the TEM mode from propagating in the coplanar line 30. The interval is equal to or less than a cut-off frequency of electromagnetic waves propagating in the coplanar line 30.

Like the microstrip line 10 in FIG. 1, the coplanar line 30 also extends in a direction (Z direction) orthogonal to a stacking direction of the ground electrodes 41 and 43 of the waveguide 40, and its end portion is directly connected to the ground electrode 43 as one of the ground electrodes from the stacking direction side and is made conductive. The magnetic field of the coplanar line 30 is also connected in an E plane of the waveguide 40.

Specifically, since the mode is the TEM mode, in a manner similar to the case of the microstrip line 10 shown in FIG. 4A, the magnetic field of the coplanar line 30 is distributed circularly around the line pattern 33. On the other hand, for example, in a TE mode of the lowest order ($TE_{10}$ mode), in a manner similar to the waveguide 20 shown in FIG. 4B, the magnetic field of the waveguide 40 is distributed in one direction in the section. Therefore, by matching the direction of the magnetic field of the waveguide 40 and that of the magnetic field of the coplanar line 30 in the E plane of the waveguide 40, the magnetic fields are coupled and conversion from the TEM mode to the TE mode is performed.

Figure 9A:
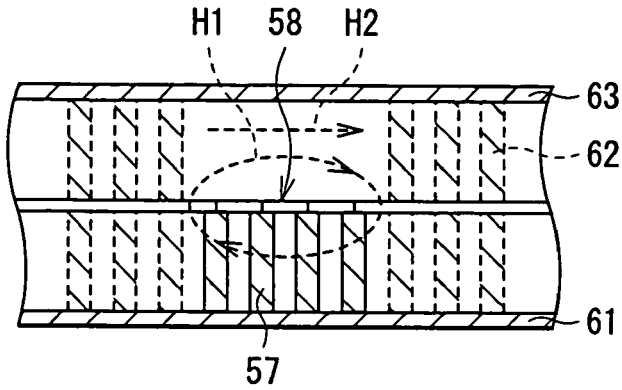
FIGS. 9A and 9B are diagrams illustrating a magnetic field coupling portion in the RF module shown in FIG. 3.
Figure 10A:
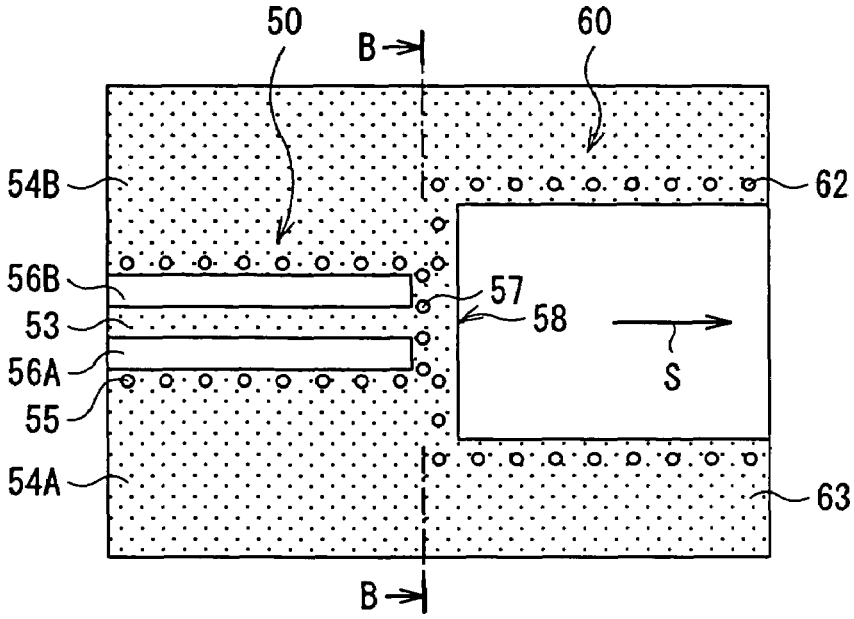
FIGS. 10A and 10B are plan views of an intermediate layer in the RF module shown in FIG. 3.

In the RF module shown in FIG. 3 as a configuration example, a strip line 50 is used as the first waveguide, and a waveguide 60 having a multilayer structure is used as the second waveguide. The strip line 50 and the waveguide 60 share two dielectric substrates 52A and 52B stacked, and are constructed integrally. FIG. 10A is a plan view of an intermediate layer portion of the RF module. FIG. 9A is a section of the connection portion between the strip line 50 and the waveguide 60. FIG. 9A corresponds to a section taken along line B-B of FIG. 10A.

The waveguide 60 has three ground electrodes 61, 63, and 64 which face each other and a plurality of through holes 62 as conductors for bringing the ground electrodes 61, 63, and 64 into conduction. The lower ground electrode 61 is uniformly provided on the bottom face of the lower dielectric substrate 52A. The upper ground electrode 63 is uniformly provided on the top face of the upper dielectric substrate 52B. The intermediate ground electrode 64 is provided between the dielectric substrates 52A and 52B and on the side of the electromagnetic wave propagation region. A configuration in which the intermediate ground electrode 64 is not provided can be also employed. In the waveguide 60, electromagnetic waves propagate, for example, in the S direction of the drawing in the region surrounded by the upper and lower ground electrodes 61 and 63 and the through holes 62.

The waveguide 60 may have a configuration of a dielectric waveguide in which the electromagnetic wave propagation region is filled with a dielectric or a configuration of a cavity waveguide having therein a cavity. The sectional shape of the through hole 62 is not limited to a circular shape but may be another shape such as a polygonal shape or an oval shape.

The strip line 50 has a lower ground electrode 51 formed uniformly on the bottom face of the lower dielectric substrate 52A, an upper ground electrode 59 formed uniformly on the top face of the upper dielectric substrate 52B, a line pattern 53 made of a conductor formed between the dielectric substrates 52A and 52B, and intermediate ground electrodes 54A and 54B formed in the width direction of the line pattern 53. In the width direction of the line pattern 53, between the intermediate ground electrodes 54A and 54B, regions 56A and 56B in which a conductor is not provided are formed. A configuration in which the intermediate ground electrodes 54A and 54B are not provided can be also employed.

In the strip line 50, a plurality of through holes 55 as penetrating conductors are provided along the line pattern 53 like in the coplanar line 30 in FIG. 2. The through holes 55 penetrate the dielectric substrates 52A and 52B and bring the ground electrodes 51, 59, 54A, and 54B into conduction. The through holes 55 are provided to prevent electromagnetic waves in modes (TE and TM modes) other than the TEM mode from propagating in the strip line 50 like in the coplanar line 30 in FIG. 2.

The line pattern 53 of the strip line 50 extends in a direction (Z direction) orthogonal to a stacking direction of the ground electrodes 51, 59, 54A and 54B of the waveguide 60, and its end portion is indirectly connected to the lower ground electrode 61 from the stacking direction side and is made conductive.

More specifically, as also shown in FIGS. 9A and 10A, through holes 57 are provided near an end of the line pattern 53 in a connection portion 58 between the strip line 50 and the waveguide 60. By the through holes 57, the line pattern 53 is conductively connected to the lower ground electrode 61 in the waveguide 60 indirectly. It is also possible to provide the through holes 57 on the upper side and to bring the upper ground electrode 63 into conduction.

The magnetic field of the strip line 50 is connected in an E plane of the waveguide 60. When the waveguide 60 is in the TE mode and the electromagnetic wave travel direction S is the Z direction in FIG. 3, the E plane of the waveguide 60 is parallel to the XY plane in the diagram.

Specifically, since the mode is the TEM mode, the magnetic field of the strip line 50 is distributed circularly around the line pattern 53. On the other hand, for example, in a TE mode of the lowest order ($TE_{10}$ mode), the magnetic field of the waveguide 60 is distributed in one direction in the section. Assuming now that the waveguide is divided into upper and lower regions in the connection portion 58, as shown in FIG. 9A, the through holes 57 are provided in the lower region. Consequently, the magnetic field H1 of the strip line 50 is distributed mainly only in the upper region in the connection portion 58. The upper region is used as a window of coupling to the waveguide 60, and the direction of the magnetic field H2 of the waveguide 60 and that of the magnetic field H1 of the strip line 50 match with each other, thereby coupling the magnetic fields in the E plane and performing conversion from the TEM mode to the TE mode.

Figure 9B:
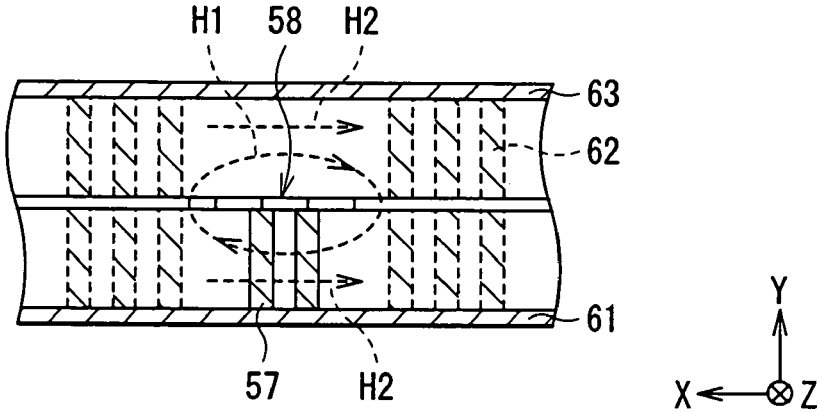
Figure 10B:
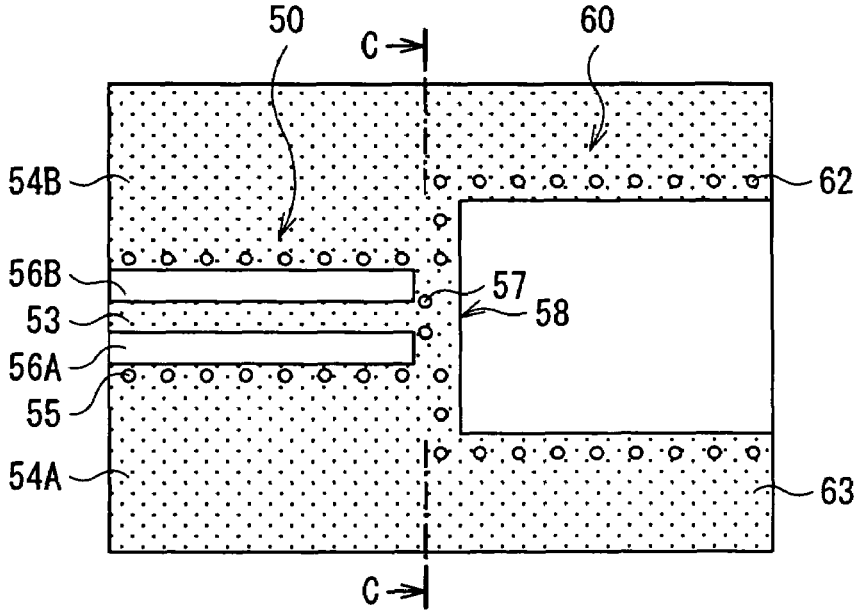

As shown in FIGS. 9B and 10B, it is also possible to reduce the number of the through holes 57 in the connection portion 58 and to provide a coupling window not only in the upper region but also in the lower region. FIG. 9B corresponds to a section taken along line C-C of FIG. 10B. In this case, in the lower region, the direction of the magnetic field H2 of the waveguide 60 and that of the magnetic field H1 of the strip line 50 become opposite to each other, so that the degree of magnetic field coupling is lowered. On the other hand, in the case of providing the coupling window only in the upper region as shown in FIG. 9A, the degree of magnetic field coupling is the highest. Therefore, by adjusting the size of the coupling window provided in the lower region, coupling adjustment can be carried out.

The action of the RF module having any of the above-described configurations will now be described.

In the RF module having any of the configurations, electromagnetic waves in the TEM mode propagate in the first waveguide (microstrip line 10, coplanar line 30, and strip line 50). For example, in the coplanar line 30 of FIG. 2, the through holes 35 are provided at the interval W equal to or lower than a cut-off frequency (FIG. 5) in the width direction of the line pattern 33, so that electromagnetic waves in a mode (TE or TM mode) other than the TEM mode do not propagate.

The electromagnetic waves in the TEM mode propagate into the second waveguide (waveguides 20, 40, and 60) for propagating electromagnetic waves in a mode other than the TEM mode. In the connection portion between the first and second waveguides, as shown in FIGS. 4A to 4C and the like, magnetic fields are coupled in the E plane of the second waveguide so that the direction of the magnetic field H1 of the electromagnetic waves propagating to the first waveguide and that of the magnetic field H2 of the electromagnetic waves propagating to the second waveguide match with each other, thereby performing conversion from the TEM mode to another mode.

A method of adjusting the degree of magnetic field coupling will be described by taking the case where the coplanar line 30 is used as the first waveguide as an example.

A first adjusting method is a method of adjusting the degree of coupling by the interval W (FIG. 5) of the through holes 35 provided around the line pattern 33. In this case, when the interval W is shortened, the degree of coupling is lowered.

Figure 6:
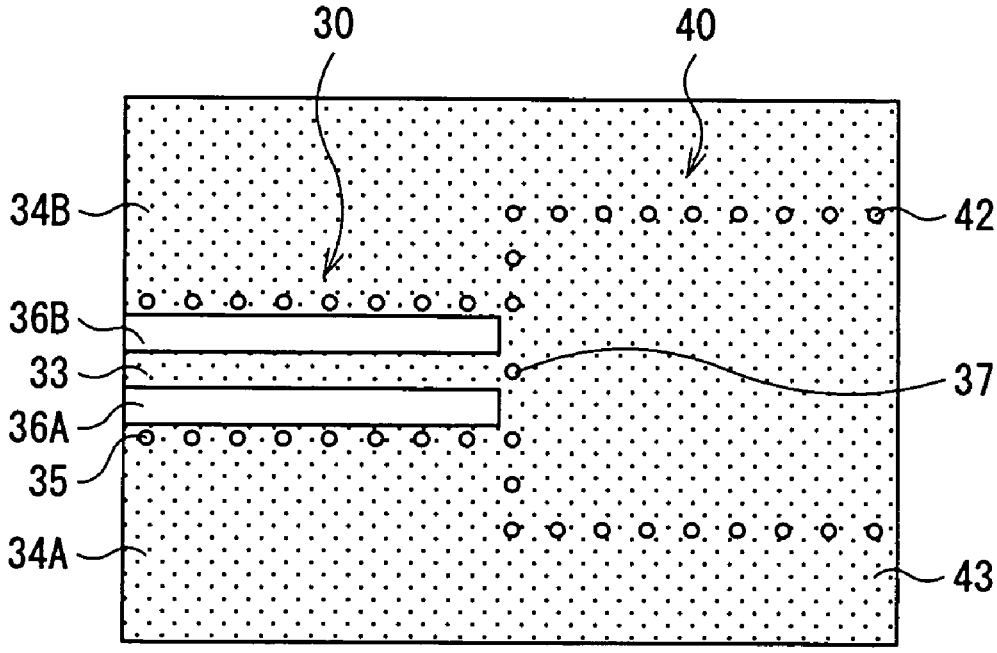
FIG. 6 is a diagram illustrating coupling adjustment in the RF module shown in FIG. 2.

A second adjusting method is a method of providing a through hole 37 for coupling adjustment near the portion where the line pattern 33 is connected as shown in FIG. 6. The internal face of the through hole 37 for coupling adjustment is metalized and the through hole 37 brings the upper and lower ground electrodes 41 and 43 into conduction. The sectional shape of the through hole 37 for coupling adjustment is not limited to a circular shape but may be another shape such as a polygonal shape or an oval shape.

Figure 11A:
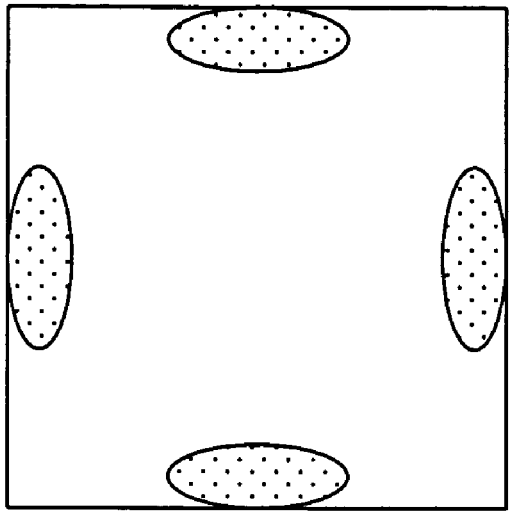
FIGS. 11A and 11B are diagrams each showing an example of the magnetic field distribution in a waveguide having a polygonal shape.
Figure 11B:
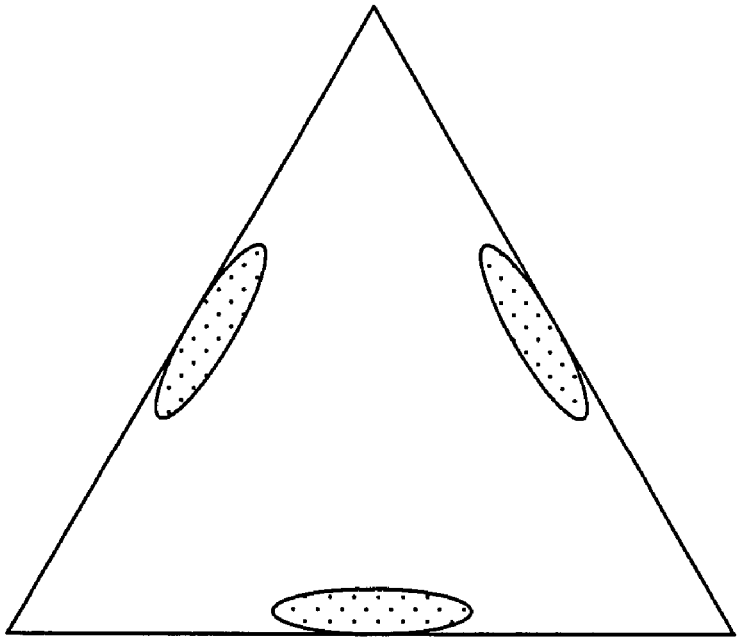

As shown in FIGS. 11A and 1B, generally, in a waveguide having a polygon shape (cavity resonator), the magnetic field strength is the maximum around the center of each of sides of the polygon shape. FIGS. 11A and 11B show magnetic field distributions in the H plane in waveguides having a square sectional shape and a triangle sectional shape, respectively, in the H plane direction. In each of the diagrams, a hatched region is a region where the magnetic field strength is high.

Therefore, in the second adjusting method shown in FIG. 6, the degree of coupling can be adjusted by the position where the through hole 37 for coupling adjustment is provided in consideration of the magnetic field strength distribution. Specifically, for example, by providing the through hole 37 for coupling adjustment in a place where the magnetic field strength is high (the center of each of the sides in the case of a polygon shape) on the waveguide 40 side, the degree of coupling can be adjusted. The more the number of through holes 37 for coupling adjustment is increased, the lower the degree of coupling becomes.

Figure 7:
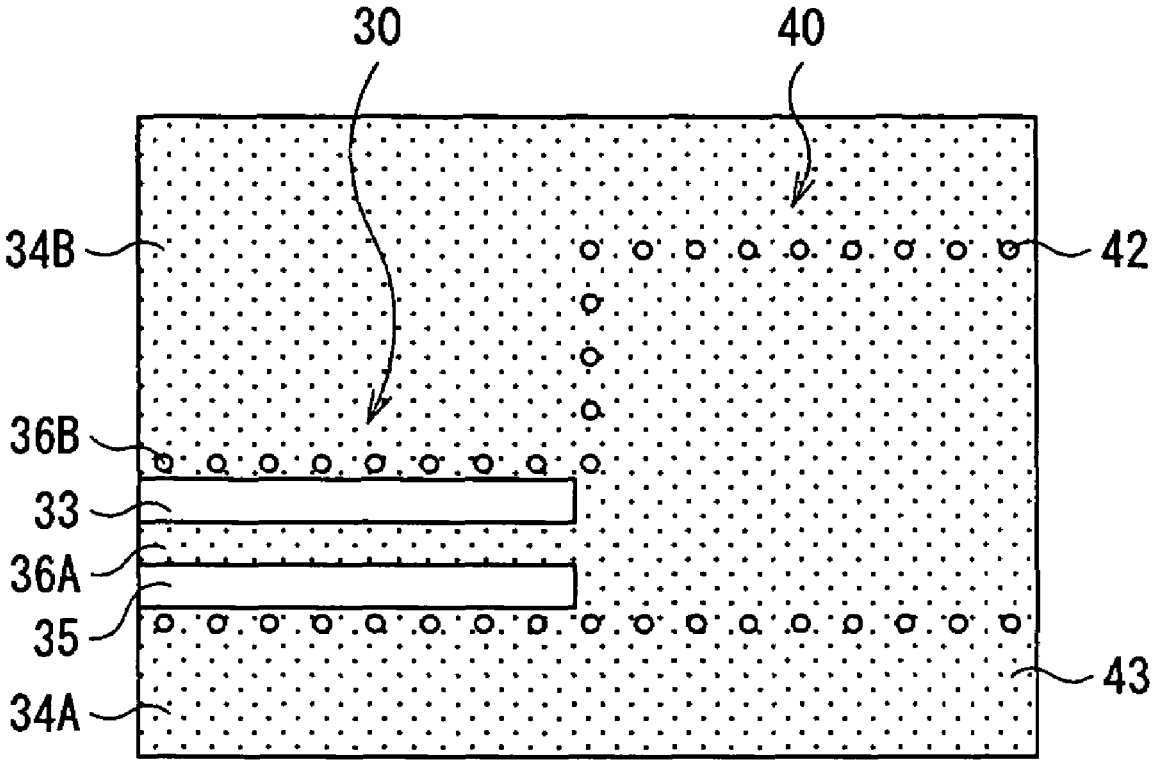
FIG. 7 is a diagram showing another example of coupling adjustment in the RF module illustrated in FIG. 2.

A third adjusting method is a method of adjusting the position itself where the line pattern 33 is connected in consideration of the magnetic field strength distribution. When the line pattern 33 is connected around the center of a side of the waveguide 40 as shown in FIG. 5, the magnetic field strength is high in the position, so that the degree of coupling is high. On the contrary, as shown in FIG. 7, when the line pattern 33 is connected in a position away from the center of a side, the degree of coupling is lowered.

Figure 8A:
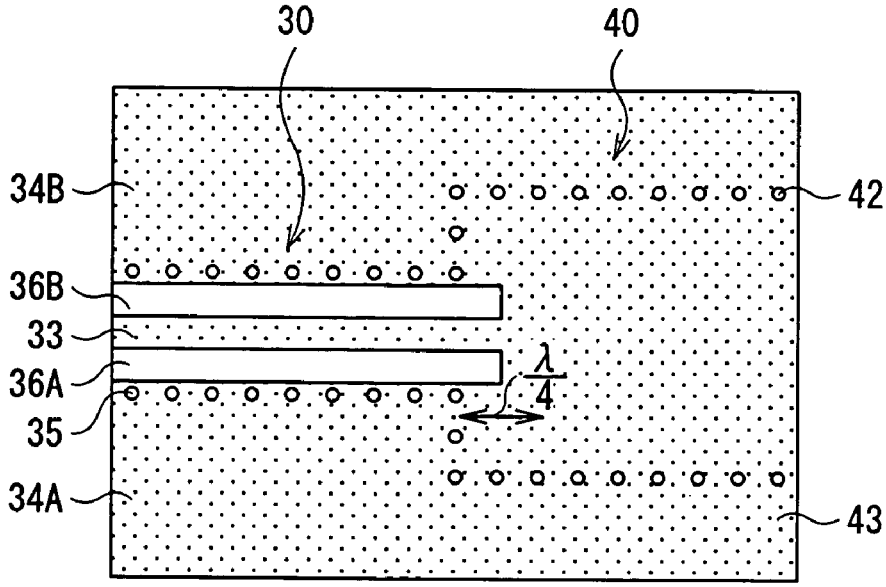
FIGS. 8A and 8B are diagrams showing further another example of coupling adjustment in the RF module illustrated in FIG. 2.
Figure 8B:
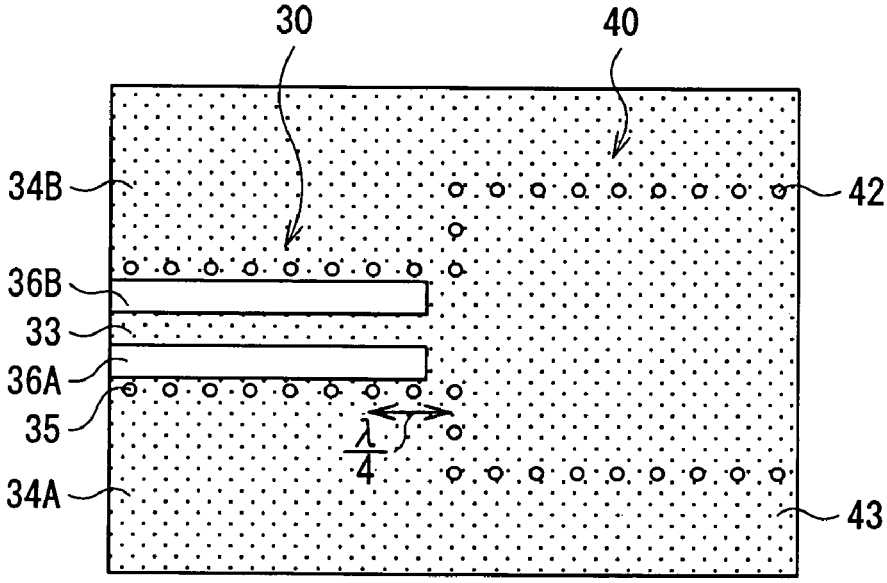

A fourth adjusting method is a method of adjusting the position of an end portion of the line pattern 33 in the connection portion. For example, as shown in FIG. 8A, it is also possible to extend the line pattern 33 so that its end lies in the waveguide 40. In this case, the line pattern 33 is extended within the range of the length of ¼ of the signal wavelength λ. The more the end of the line pattern 33 is positioned to the inner side of the waveguide 40, the degree of coupling is lowered. On the contrary, as shown in FIG. 8B, the line pattern 33 can be shortened so that its end is positioned away from the waveguide 40. In this case, the line pattern 33 is shortened within the range of the length of ¼ of the signal wavelength λ. The more the end of the line pattern 33 is apart from the waveguide 40, the degree of coupling is lowered.

As already described with reference to FIGS. 9A and 9B, in the case of the RF module shown in FIG. 3, a method of adjusting coupling by the size of the coupling window provided in the upper and lower regions in the connection portion 58 can be employed.

Although electromagnetic waves propagate from the first waveguide to the second waveguide in the above description, alternately, electromagnetic waves may propagate from the second waveguide to the first waveguide.

As described above, according to the embodiment, an end portion of the first waveguide is directly or indirectly connected to one of the ground electrodes of the second waveguide from the direction orthogonal to the stacking direction side of the ground electrodes so as to be conductive, and the magnetic fields are coupled so that the directions of the magnetic fields of the first and second waveguides are matched in the E plane. Thus, mode conversion between the TEM mode and another mode can be excellently performed between the waveguides.

According to the embodiment, the first and second waveguides can be manufactured integrally by using the same substrate, so that manufacturing is easy. The first and second waveguides can be connected in a plane structure, so that the whole structure can be simplified. Because of the plane structure, for example, it is easy to form the RF module as a chip and mount the chip on another substrate.

According to the embodiment, the first waveguide is conductively connected directly to the ground electrode or indirectly to the ground electrode of the second waveguide. Consequently, without changing the connection position, the magnetic fields can be coupled at the maximum efficiency in a wide frequency range.

Figure 12A:
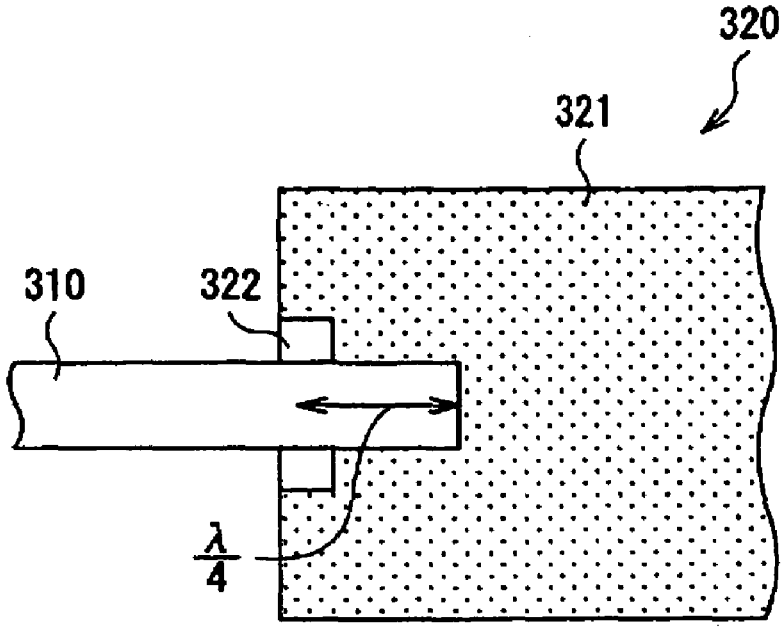
FIG. 12A RELATED ART
FIGS. 12A and 12B are diagrams showing a comparative example of the RF module according to the embodiment of the invention.
Figure 12B:
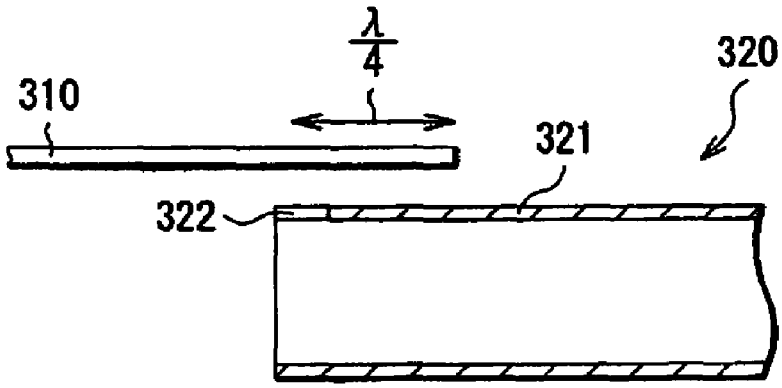
FIG. 12B RELATED ART

This will be described by referring to a mode converting structure as a comparative example shown in FIGS. 12A and 12B. FIG. 12A is a plan view of the mode converting structure and FIG. 12B shows a configuration in a side face direction. In the mode converting structure, a coupling window 322 is formed in a part of a ground electrode 321 in a second waveguide 320. A case of coupling a first waveguide 310 such as a microstrip line whose end is an open end to the second waveguide 320 at the maximum efficiency will be considered. In this case, as shown in the diagrams, by positioning the coupling window 322 at a length of $\lambda/4$ ($\lambda$: signal wavelength) from the open end of the first waveguide 310, the degree of coupling becomes the maximum. However, in the case of such a mode converting structure, to realize coupling at the maximum efficiency, the positional relation between the first waveguide 310 and the coupling window 322 has to be corrected in accordance with signal frequency.

In contrast, in the case of the mode converting structure of the embodiment, the first and second waveguides are directly connected so as to be conductive in the connection portion. Consequently, even if the signal frequency changes, the magnetic fields can be always coupled (mode can be converted) at the maximum efficiency without adjustment of the connection position. That is, the magnetic fields can be coupled at the maximum efficiency in a wide range.

[Modifications]

Modifications of the RF module, and the mode converting structure and method will now be described.

[First Modification]

Figure 13:
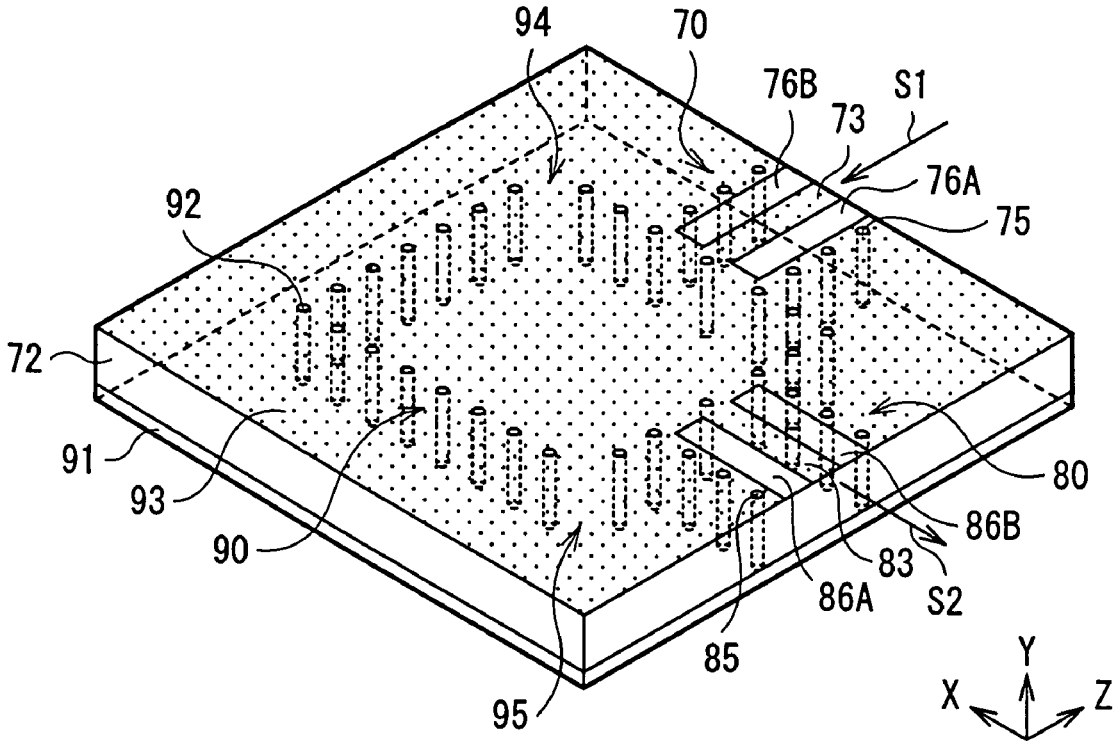
FIG. 13 is a perspective view showing the configuration of the RF module of a first modification.
Figure 14:
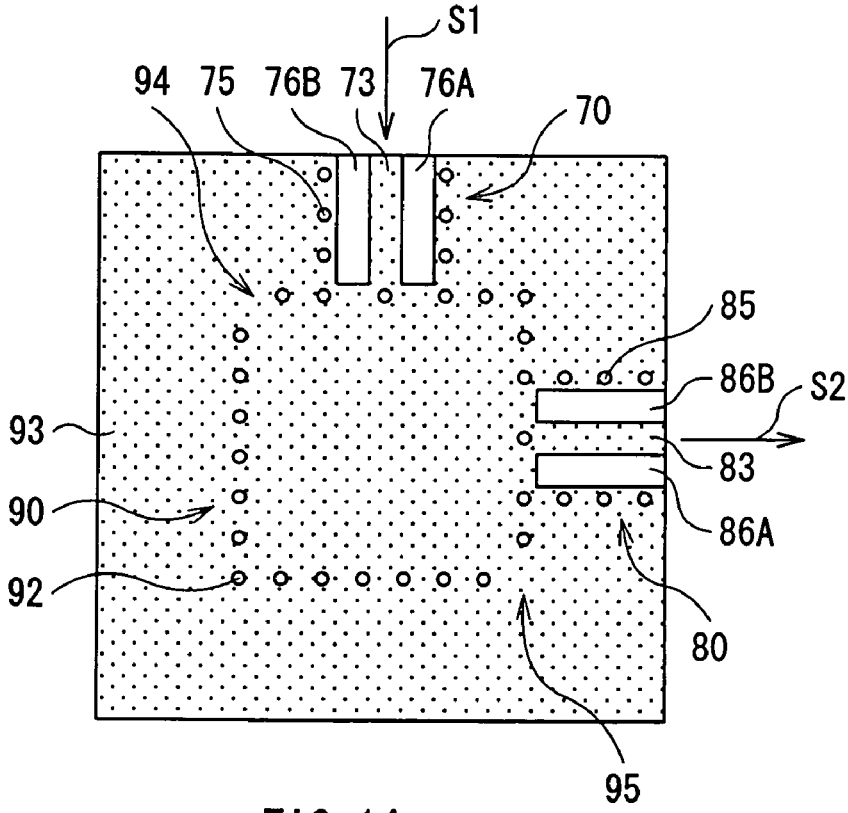
FIG. 14 is a plan view of the RF module shown in FIG. 13.

FIG. 13 shows the configuration of an RF module in a first modification. FIG. 14 is a plan view of the RF module. In FIG. 13, for simplicity of the drawing, the thickness of the uppermost layer is omitted and the uppermost layer is hatched. In the first modification, a waveguide 90 in a multiple mode (double mode) is used as the second waveguide. In the configuration example, coplanar lines 70 and 80 as the first waveguide are connected to the signal input/output portion of the waveguide 90 in the double mode. The coplanar lines 70 and 80 and the waveguide 90 share a single dielectric substrate 72 and are constructed integrally. In the RF module, for example, an input signal S1 is input from the coplanar line 70 side to the waveguide 90 and an output signal S2 is output from the coplanar line 80 side.

As shown in FIG. 13, the waveguide 90 has ground electrodes 91 and 93 facing each other, and a plurality of through holes 92 as conductors for bringing the ground electrodes 91 and 93 into conduction. In a region surrounded by the ground electrodes 91 and 93 and the through holes 92, electromagnetic waves propagate in two modes. The through holes 92 are arranged in, for example, an almost square shape as a whole.

The configuration of each of the coplanar lines 70 and 80 is basically similar to the coplanar line 30 in FIG. 2. The coplanar lines 70 and 80 have line patterns 73 and 83, respectively, each made of a conductor and formed in a line shape on the top face of the dielectric substrate 72. Around the line patterns 73 and 83, a plurality of through holes 75 and 85 as penetrating conductors are provided around the line patterns 73 and 83, respectively, so as to prevent electromagnetic waves in a mode other than the TEM mode from propagating in the coplanar lines 70 and 80. In the width direction of the line pattern 73, regions 76A and 76B in which a conductor is not provided are formed between the through holes 75 and the line pattern 73. In the width direction of the line pattern 83, regions 86A and 86B in which a conductor is not provided are formed between the through holes 85 and the line pattern 83.

In a manner similar to the other configuration examples, the coplanar lines 70 and 80 extend in the direction orthogonal to the stacking direction of the ground electrodes 91 and 93, and an output end or input end of each of the coplanar lines 70 and 80 is directly connected from the direction orthogonal to the stacking direction to the ground electrode 93 as one of the ground electrodes and is made conductive. The magnetic fields of the coplanar lines 70 and 80 are coupled in the E plane of the waveguide 90.

Figure 15A:
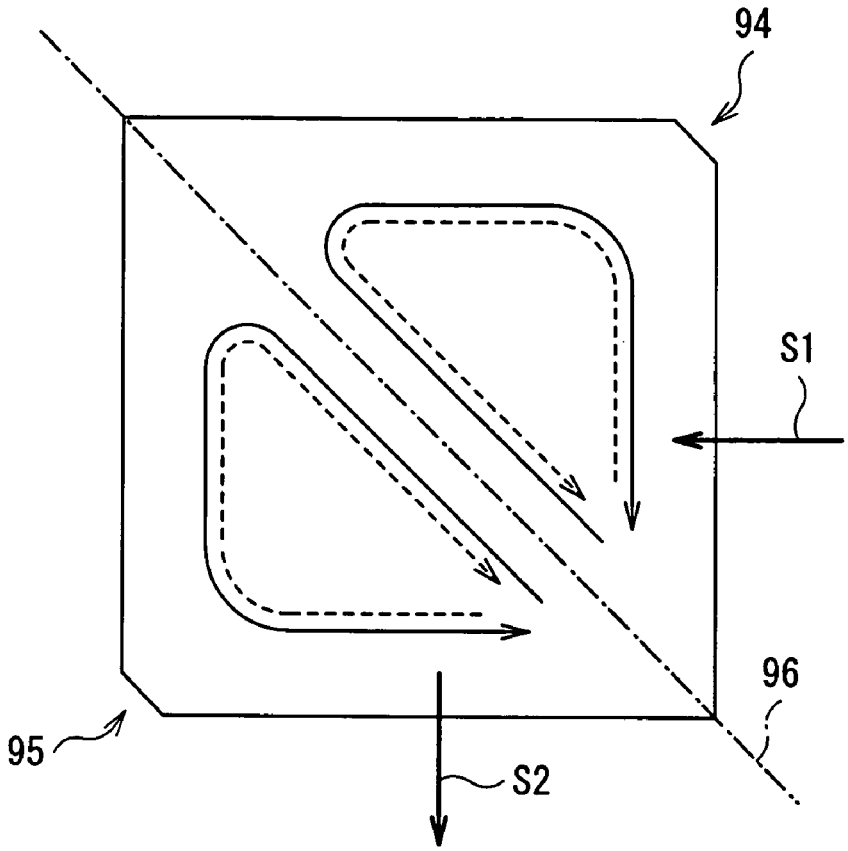
FIGS. 15A and 15B are diagrams each showing a mode of a magnetic field distribution in the RF module of FIG. 13.
Figure 15B:
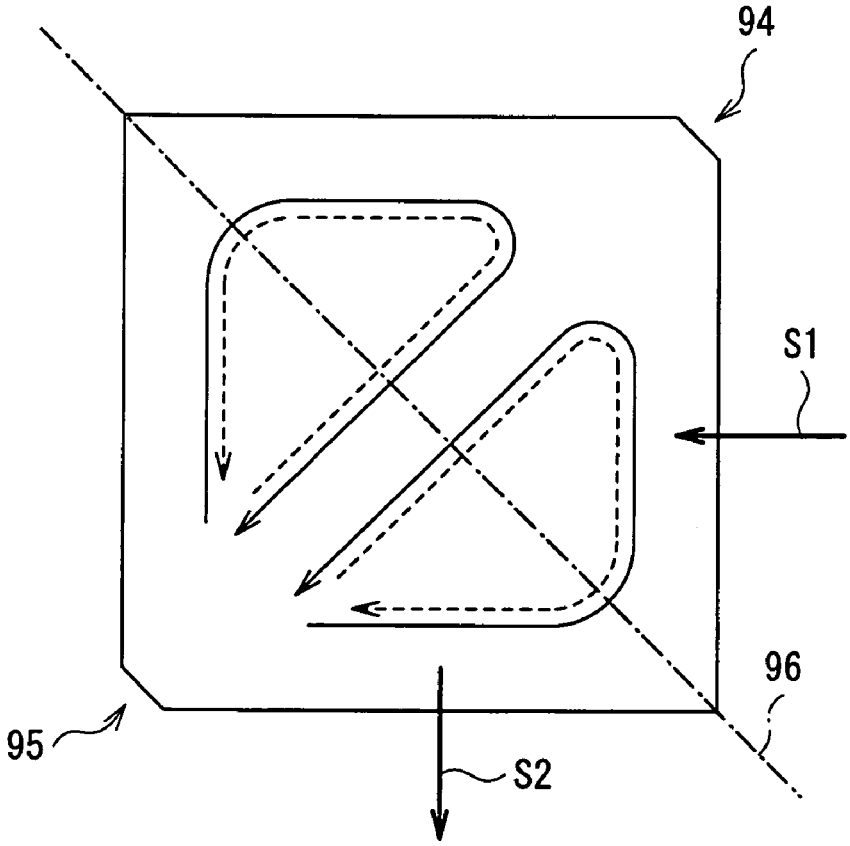

FIGS. 15A and 15B show magnetic field distributions in two modes of the waveguide 90. The waveguide 90 has a first mode (FIG. 15A) in which magnetic fields are distributed in parallel to a structural symmetry plane 96 and a second mode (FIG. 15B) in which magnetic fields are distributed perpendicular to the symmetry plane 96. In the waveguide 90, by changing the shape of an electromagnetic wave propagation region in positions 94 and 95 on a diagonal line which is orthogonal to the symmetry plane 96, the signal frequency band can be adjusted. For example, by changing the shape of the propagation region to a corner-rounded shape as shown in the diagrams, the bandwidth can be widened.

Figure 16A:
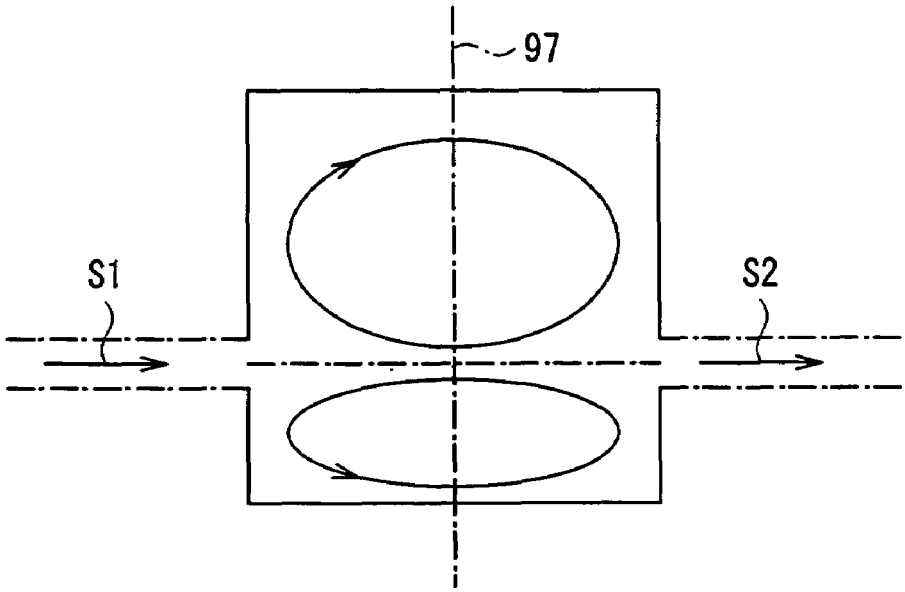
FIGS. 16A and 16B are diagrams illustrating other examples of a double mode.
Figure 16B:
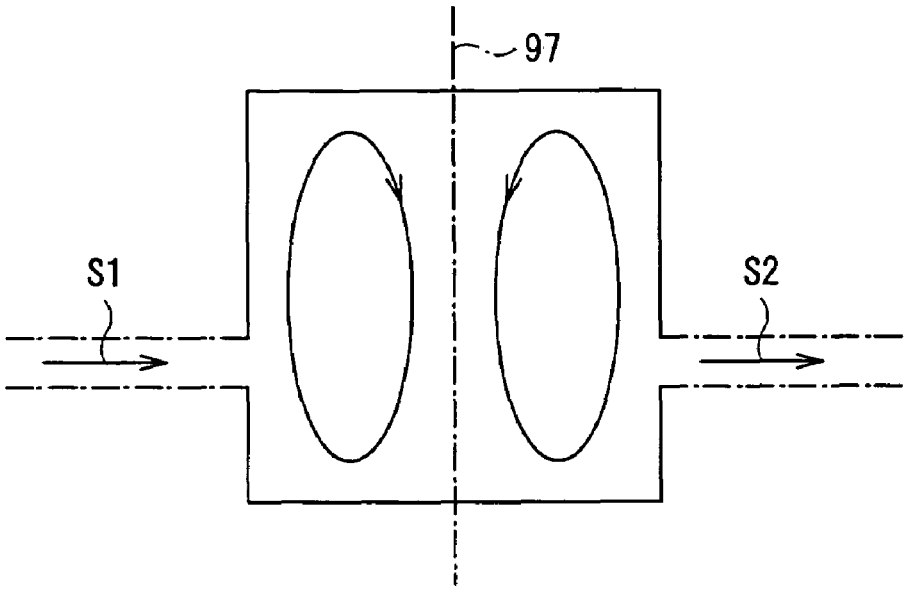

Other than the configuration, the waveguide of the double mode has various configurations. An example is a waveguide which oscillates in two magnetic field distribution modes as shown in FIGS. 16A and 16B. The waveguide also has a first mode (FIG. 16B) in which magnetic fields are distributed in parallel to a structural symmetry plane 97, and a second mode (FIG. 16A) in which magnetic fields are distributed perpendicular to the symmetrical plane 97. The mode converting structure of the embodiment can be applied also to the double-mode waveguide having other configurations.

As described above, according to the modification, the waveguide of the TEM mode can be connected also to the double-mode waveguide 90 and conversion between the TEM mode and another mode can be carried out.

[Second Modification]

Figure 17:
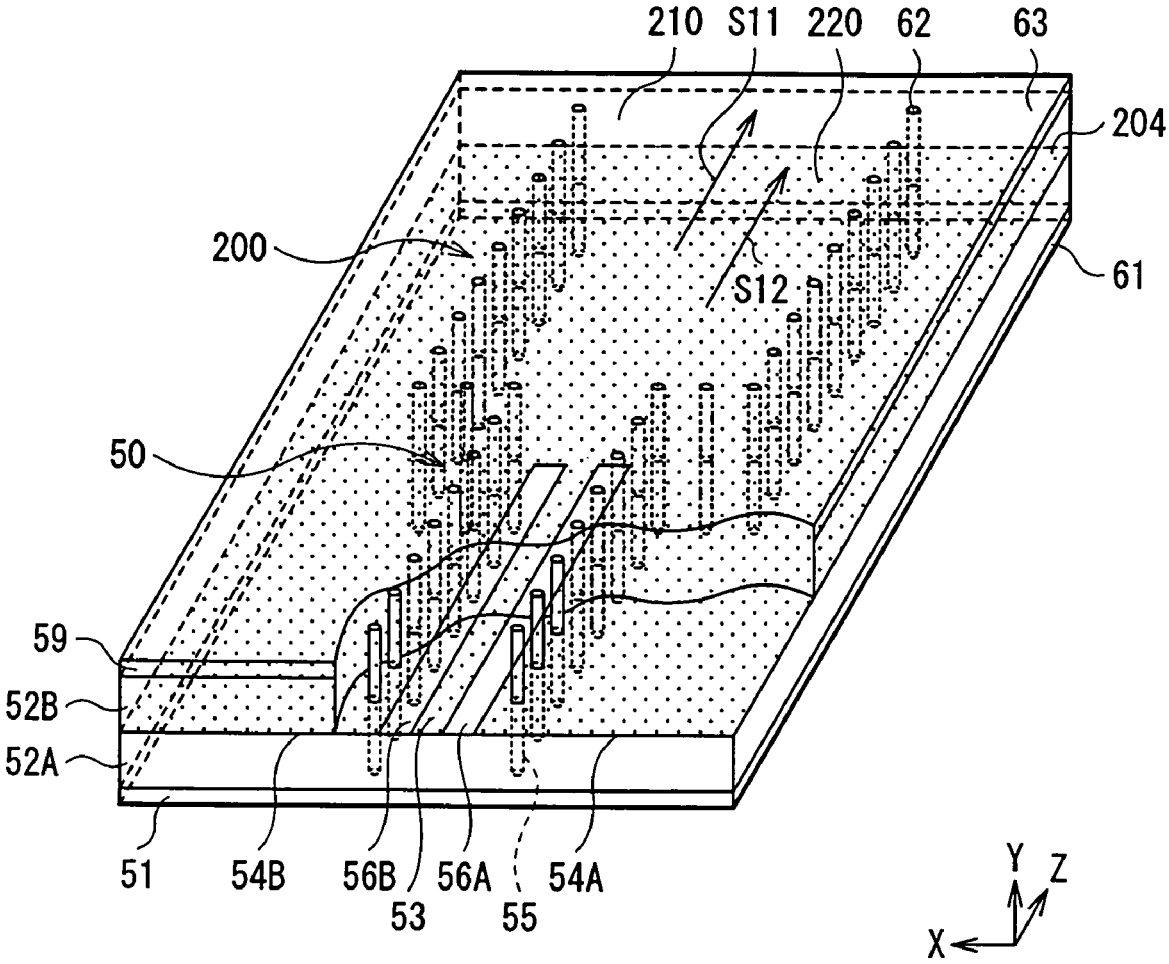
FIG. 17 is a partially-cutaway perspective view showing the configuration of an RF module of a second modification.
Figure 18:
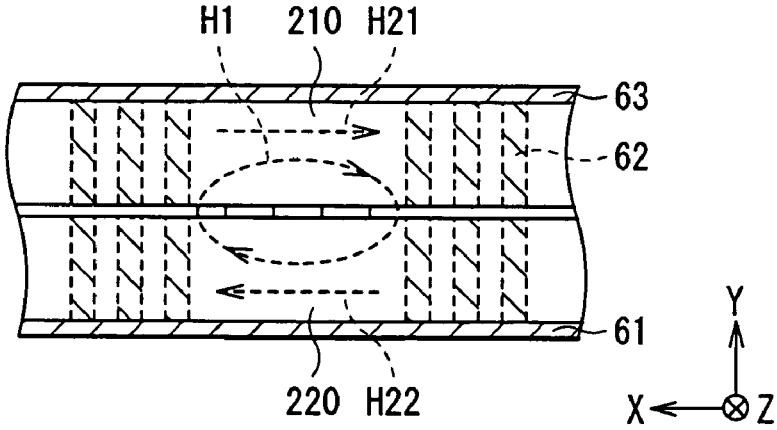
FIG. 18 is a diagram showing a magnetic field coupling portion in the RF module illustrated in FIG. 17.
Figure 19A:
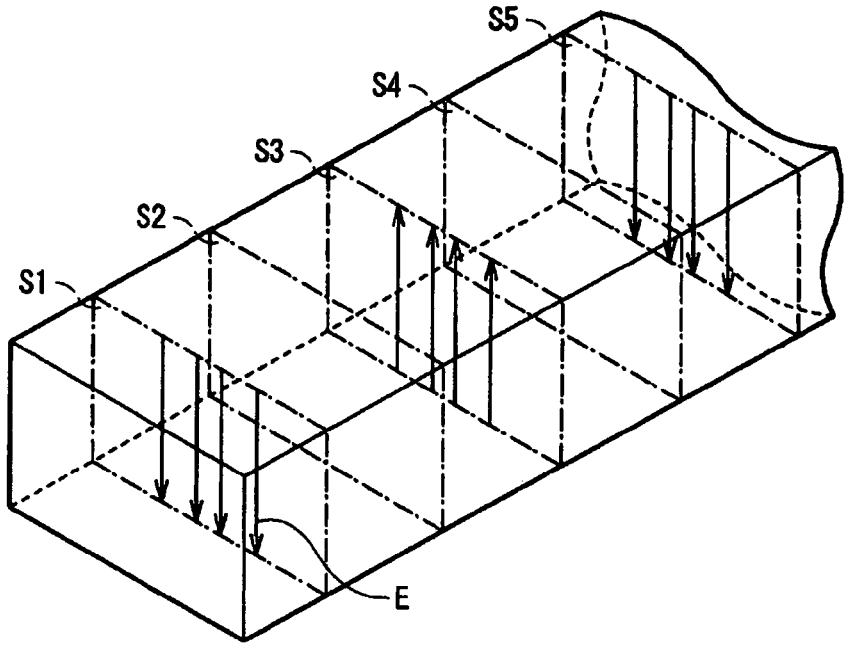
FIG. 19A RELATED ART
FIGS. 19A and 19B are diagrams each showing an electromagnetic field distribution in a waveguide in the TE mode.
Figure 19B:
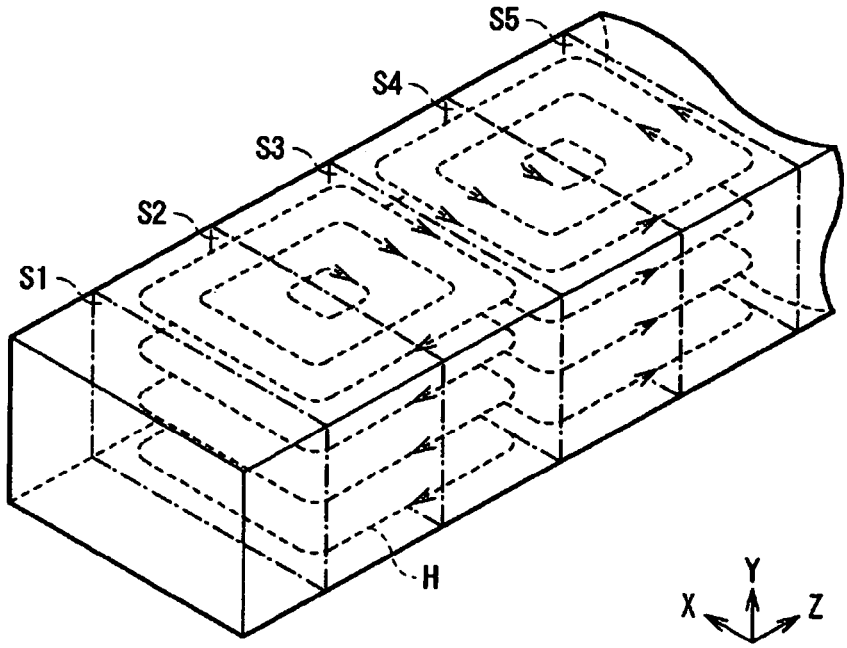
FIG. 19B RELATED ART
Figure 22A:
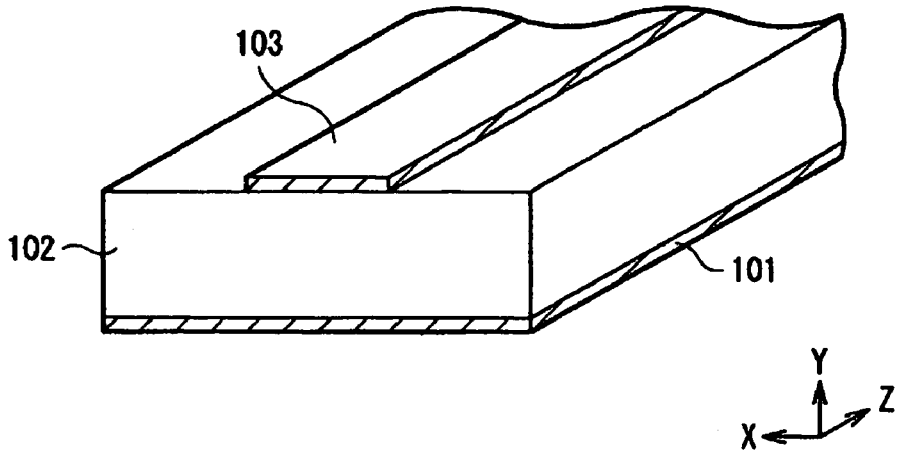
FIG. 22A RELATED ART
FIGS. 22A and 22B are configuration diagrams of a microstrip line and a coaxial line, respectively.
Figure 22B:
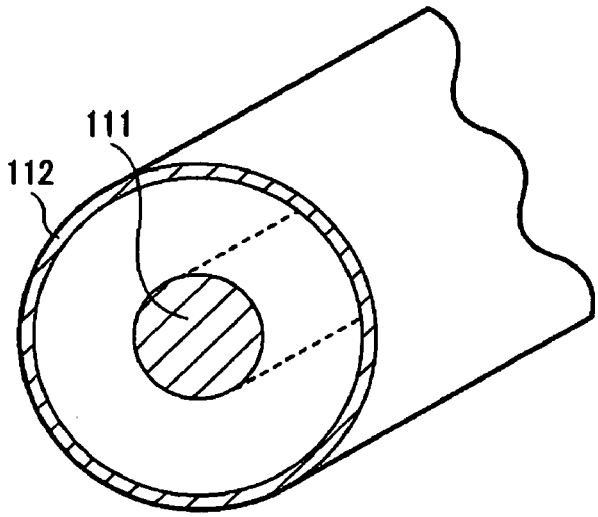
FIG. 22B RELATED ART
Figure 23A:
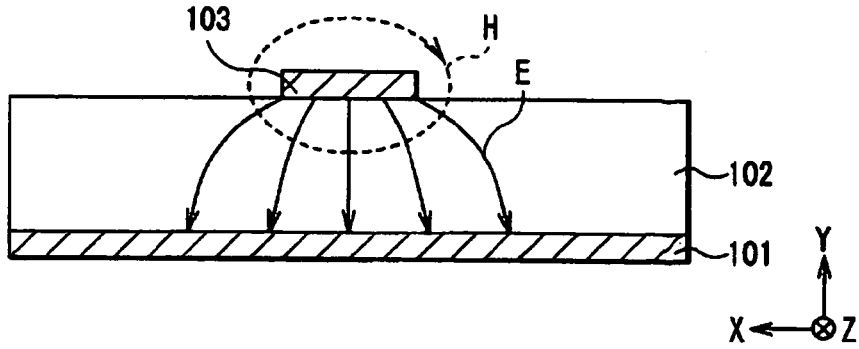
FIG. 23A RELATED ART
FIGS. 23A and 23B are diagrams illustrating electromagnetic field distributions in the TEM mode in the microstrip line and the coaxial line, respectively.
Figure 23B:
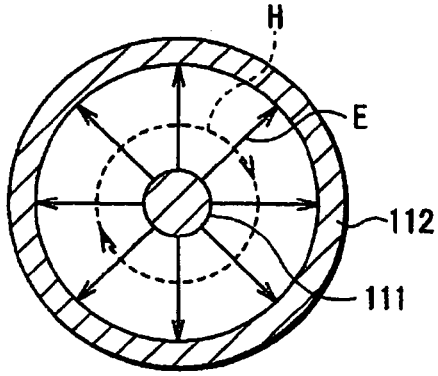
FIG. 23B RELATED ART
Figure 24:
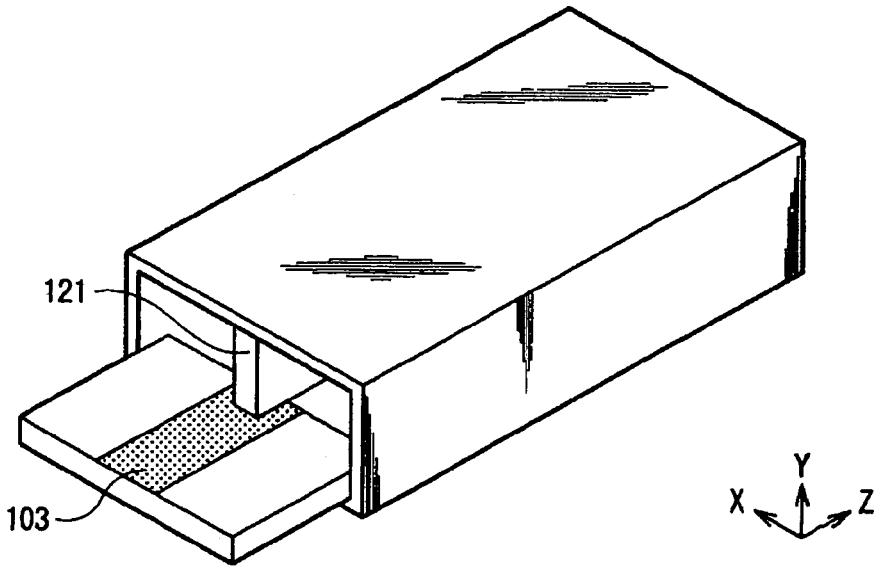
FIG. 24 RELATED ART
FIG. 24 is a perspective view showing an example of a conventional connecting structure of a microstrip line and a waveguide.
Figure 25A:
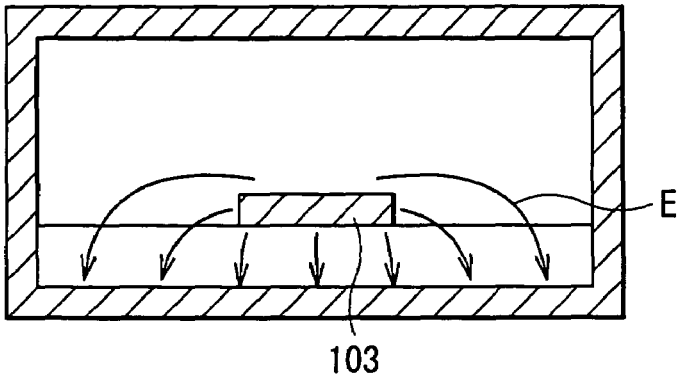
FIG. 25A RELATED ART
FIGS. 25A, 25B and 25C are diagrams each showing an electric field distribution in the connecting structure illustrated in FIG. 24.
Figure 25B:
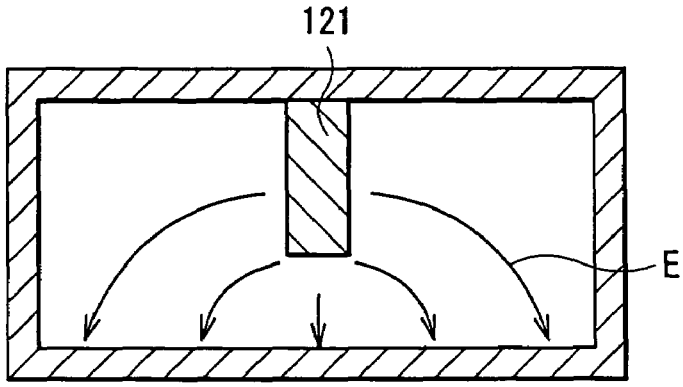
FIG. 25B RELATED ART
Figure 25C:
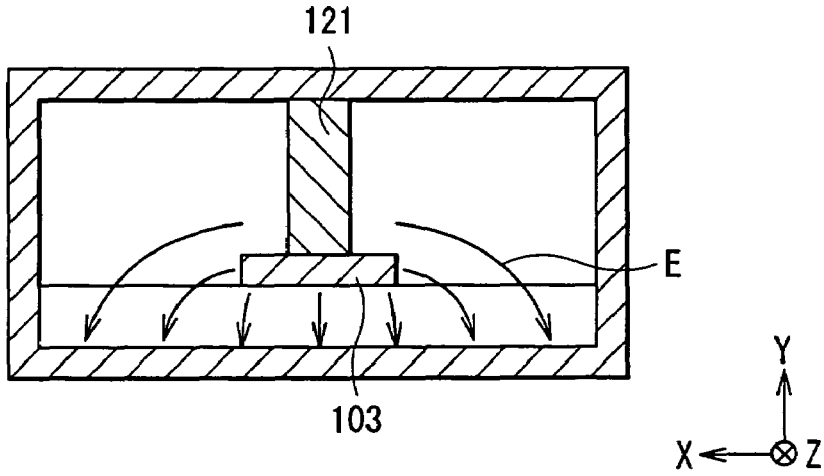
FIG. 25C RELATED ART

FIG. 17 shows the configuration of an RF module according to a second modification. FIG. 18 shows the configuration of the connection portion between the first and second waveguides in the RF module. In FIG. 17, to simplify the drawing, the thickness of an intermediate layer is omitted and the intermediate layer is hatched. This modification is a modification of the RF module of FIG. 3. The components similar to those of FIG. 3 are designated by the same reference numerals and their description will not be repeated.

The RF module of FIG. 3 has only one electromagnetic wave propagation region in the waveguide 60. In the modification, a waveguide 200 having a multilayer structure has a plurality of electromagnetic wave propagation regions. Specifically, a ground electrode 204 is provided uniformly on the intermediate layer and a plurality of propagation regions are provided in the stacking direction. More specifically, a region surrounded by the intermediate ground electrode 204, upper ground electrode 63, and through holes 62 is set as a first propagation region 210. A region surrounded by the intermediate ground electrode 204, lower ground electrode 61, and through holes 62 is set as a second propagation region 220. In such a manner, the two propagation regions 210 and 220 are formed so as to be adjacent to each other in the stacking direction. In the propagation regions 210 and 220, electromagnetic waves propagate, for example, in directions S11 and S12, respectively, in FIG. 17.

In the RF module of FIG. 3, in the connection portion 58 with the waveguide 60, the line pattern 53 of the strip line 50 is connected indirectly to the lower ground electrode 61 via the through hole 57. In the modification, the end portion of the line pattern 53 is directly connected to the intermediate ground electrode 204 and is made conductive so that the electromagnetic waves propagated through the strip line 50 is branched and propagate into the two propagation regions 210 and 220.

In the modification, the magnetic field of the strip line 50 is coupled in the E plane of each of the two propagation regions 210 and 220. Specifically, as shown in FIG. 18, in the TEM mode, the magnetic field from the strip line 50 is distributed circularly around the line pattern 53. On the other hand, for example, in a TE mode of the lowest order ($TE_{10}$ mode), the magnetic field of the waveguide 200 is distributed in one direction in the section of each of the propagation regions 210 and 220. Therefore, by setting the directions of the magnetic fields H21 and H22 in the propagation regions 210 and 220 to be opposite to each other, the directions of the magnetic fields H21 and H22 can be made coincide with the direction of the magnetic field H1 of the strip line 50. Thus, in the E plane of each of the propagation regions 210 and 220, the magnetic fields are coupled excellently and conversion from the TEM mode to the TE mode is performed.

In the modification, an RF signal propagated in the TEM mode can be branched into a plurality of signals and propagated in another mode. The mode converting structure of the modification can be suitably used for a duplexer or the like.

The invention is not limited to the foregoing embodiments but can be variously modified. Although the example of using through holes as a structure for bringing the ground electrodes in the second waveguide into conduction has been described in the foregoing embodiments, a conductor having a structure different from the through hole may be also employed. For example, a configuration may be employed in which a groove-shaped structural portion is provided in place of the through hole and the inner face of the groove is metalized to form a metal wall. Such a metal wall can be formed by, for example, a micromachining method.

As described above, in the RF module, the mode converting structure, and the mode converting method of the invention, an end of the first waveguide is directly or indirectly conductively connected to one of ground electrodes of the second waveguide from the direction orthogonal to the stacking direction of the ground electrodes, and magnetic fields of the first and second waveguides are coupled in the E plane of the second waveguide so that the direction of the magnetic field of electromagnetic waves propagated in the first waveguide and that of the magnetic field of electromagnetic waves propagated in the second waveguide match with each other. Thus, mode conversion between the TEM mode and another mode can be excellently performed between the waveguides.

Obviously many modifications and variations of the present invention are possible in the light of the above teachings. It is therefore to be understood that within the scope of the appended claims, the invention may be practiced otherwise than as specifically described.

What is claimed is:

1. An RF module comprising:

a first waveguide having a ground electrode, a dielectric substrate, and a line pattern of a conductor provided on the dielectric substrate, for propagating electromagnetic waves in a TEM mode; and a second waveguide connected to the first waveguide, for propagating electromagnetic waves in another mode different from the TEM mode, wherein the second waveguide has a region surrounded by at least two ground electrodes facing each other and conductors for bringing the at least two ground electrodes into conduction, wherein the electromagnetic waves in said another mode propagate in the region, the first waveguide extends in a direction orthogonal to a stacking direction of the ground electrodes of the second waveguide, an end of the line pattern of the conductor is directly connected so as to be conductive to one of the ground electrodes of the second waveguide from the direction orthogonal to the stacking direction, and magnetic fields of the first and second waveguides are coupled in an E plane of the second waveguide so that the direction of the magnetic field of the electromagnetic waves propagated in the first waveguide and the direction of the magnetic field of the electromagnetic waves in said another mode propagated in the second waveguide match with each other, wherein a plurality of penetrating conductors penetrating the dielectric substrate are provided around the line pattern so as to sandwich the line pattern between the plurality of penetrating conductors and an interval between the plurality of penetrating conductors sandwiching the line pattern in the width direction is equal to or less than a cut-off frequency of the electromagnetic waves propagating through the first waveguide.

2. An RF module comprising:

a first waveguide having a ground electrode and a line pattern of a conductor for propagating electromagnetic waves in a TEM mode; and a second waveguide connected to the first waveguide, for propagating electromagnetic waves in another mode different from the TEM mode, wherein the second waveguide has a region surrounded by at least two ground electrodes facing each other and conductors for bringing the at least two ground electrodes into conduction, wherein the electromagnetic waves in said another mode propagate in the region, the first waveguide extends in a direction orthogonal to a stacking direction of the ground electrodes of the second waveguide, an end of the line pattern of the conductor is directly connected so as to be conductive to one of the ground electrodes of the second waveguide from the direction orthogonal to the stacking direction, magnetic fields of the first and second waveguides are coupled in an E plane of the second waveguide so that the direction of the magnetic field of the electromagnetic waves propagated in the first waveguide and the direction of the magnetic field of the electromagnetic waves in said another mode propagated in the second waveguide match with each other, and a penetrating conductor for coupling adjustment is provided in a coupling portion between the first and second waveguides.

3. An RF module according to claim 2, wherein the second waveguide is to propagate electromagnetic waves in another mode in a multiple mode.

4. An RF module according to claim 2, wherein the first waveguide is a stripline, a miccrostripline, or a coplanar line.

5. An RF module according to claim 2, wherein the second waveguide is to propagate electromagnetic waves in a TE mode.

6. An RF module comprising:

a first waveguide having a ground electrode and a line pattern of a conductor for propagating electromagnetic waves in a TEM mode; and a second waveguide connected to the first waveguide, for propagating electromagnetic waves in another mode different from the TEM mode, wherein the second waveguide has a region surrounded by at least two ground electrodes facing each other and conductors for bringing the at least two ground electrodes into conduction, wherein the electromagnetic waves in said another mode propagate in the region, the first waveguide is positioned between the ground electrodes facing each other in the second waveguide and extends in a direction orthogonal to a stacking direction of the ground electrodes of the second waveguide, an end of the line pattern of the conductor is directly connected so as to be conductive to one of the ground electrodes of the second waveguide from the direction orthogonal to the stacking direction, magnetic fields of the first and second waveguides are coupled in an E plane of the second waveguide so that the direction of the magnetic field of the electromagnetic waves propagated in the first waveguide and the direction of the magnetic field of the electromagnetic waves in said another mode propagated in the second waveguide match with each other, and a window is provided in at least one of a ground electrode side to which the first waveguide is conductively connected and the side opposite to the ground electrode side in the coupling portion of the first waveguide.

7. An RF module according to claim 6, wherein the second waveguide is to propagate electromagnetic waves in a TE mode.

8. An RF module according to claim 6, wherein the first waveguide is a stripline, a microstripline, or a coplanar line.

9. An RF module according to claim 6, wherein the second waveguide is to propagate electromagnetic waves in another mode in a multiple mode.

* * * * *